US011400734B2

(12) United States Patent
Arakane

(10) Patent No.: US 11,400,734 B2
(45) Date of Patent: Aug. 2, 2022

(54) IMAGE RECORDING APPARATUS

(71) Applicant: BROTHER KOGYO KABUSHIKI KAISHA, Nagoya (JP)

(72) Inventor: Satoru Arakane, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/201,411

(22) Filed: Mar. 15, 2021

(65) Prior Publication Data

US 2021/0291561 A1 Sep. 23, 2021

(30) Foreign Application Priority Data

Mar. 18, 2020 (JP) ..... JP2020-047163

(51) Int. Cl.
*B41J 11/00* (2006.01)
*B41J 13/00* (2006.01)

(52) U.S. Cl.
CPC ..... *B41J 11/008* (2013.01); *B41J 11/0095* (2013.01); *B41J 13/0009* (2013.01)

(58) Field of Classification Search
CPC .... B41J 11/008; B41J 11/0095; B41J 13/0009
See application file for complete search history.

(56) References Cited

U.S. PATENT DOCUMENTS

2007/0216718 A1* 9/2007 Mizuno ..... B41J 29/393 347/16
2012/0243005 A1* 9/2012 Nakazawa ..... G06K 15/1868 358/1.2
2015/0273901 A1 10/2015 Arai
2019/0232686 A1* 8/2019 Zaizen ..... B41J 11/009

FOREIGN PATENT DOCUMENTS

JP 2002-137509 A 5/2002
JP 2013-163292 A 8/2013
JP 2015-193085 A 11/2015

* cited by examiner

*Primary Examiner* — Henok D Legesse
(74) *Attorney, Agent, or Firm* — Scully, Scott, Murphy & Presser, PC

(57) ABSTRACT

There is provided image recording apparatus including: memory and controller. The controller is configured to store, in the memory, first identification information for identifying recorded image and minimum margin value being a minimum value of partial image margins of recorded partial images. The controller is configured to obtain second identification information for identifying image-to-be-recorded. In a case that second identification information is same as first identification information stored, the controller is configured to determine whether the minimum margin value is smaller than threshold or not, and then: in a case that the minimum margin value is smaller than threshold, the controller is configured to derive an edge position of the sheet, and then execute ejection based on the derived edge position; and in a case that the minimum margin value in not smaller than threshold, the controller is configured to execute the ejection without deriving the edge position.

19 Claims, 16 Drawing Sheets

Fig. 9

400

| MINIMUM MARGIN D/B | | |
|---|---|---|
| | FIRST IDENTIFICATION INFORMATION | MINIMUM MARGIN VALUE |
| A | FIRST IDENTIFICATION INFORMATION A | MINIMUM MARGIN VALUE A |
| ⋮ | ⋮ | ⋮ |
| N | FIRST IDENTIFICATION INFORMATION N | MINIMUM MARGIN VALUE N |

IMAGE RECORDING APPARATUS

CROSS REFERENCE TO RELATED APPLICATION

The present application claims priority from Japanese Patent Application No. 2020-047163, filed on Mar. 18, 2020, the disclosure of which is incorporated herein by reference in its entirety.

BACKGROUND

The present disclosure relates to an image recording apparatus which records an image on a sheet in accordance with the ink-jet system.

In Japanese Patent Application Laid-Open No. 2015-193085, an information processing apparatus sequentially transmits, to an image recording apparatus, a plurality of pieces of unit data indicating unit images, respectively, obtained by dividing an image of a page unit in a sub scanning direction. Margin information (blank information) indicating the width of a margin (margin width) in a unit image included in the unit images and corresponding to the margin information is added to each of the plurality of pieces of unit data.

In the image recording apparatus, in response to receipt of a first unit data, the sheet is conveyed to a cueing position so as to face a recording head (a so-called cueing processing). Next, a minimum width of the margin (minimum margin width) is specified from respective pieces of the received margin information at a point of time of the completion of conveyance; in a case that the minimum margin width is less than a threshold value, positions of both ends in a main scanning direction of the sheet located at the cueing position are detected. The recording head is then conveyed in the main scanning direction, and an ink is ejected or discharged from each of nozzles at a timing based on the positions of the both ends and based on the unit data. According to the above-described series of processings, it is possible to record, on the sheet, an image in which any deviation in the position in the main scanning direction between the sheet and the recording head is corrected.

SUMMARY

In the recent years, the speed of data processing of the image recording apparatus has been increased. As a result, the image recording apparatus might not be able to receive all of the margin information at a point of time of the completion of the cueing processing, in some cases. However, in such a case that the margin information received after the completion of the cueing processing indicates a further smaller margin width, the timing of ejecting the ink (ink ejection timing) becomes inappropriate and the image is recorded on the sheet while being lopsided to or deviated closer to one side in the main scanning direction.

The present disclosure has been made in view of the above-described situation, and an object of the present disclosure is to provide an image recording apparatus capable of further suppressing such a situation that an image is recorded on a sheet while being lopsided to or deviated closer to one side in the main scanning direction.

According to an aspect of the present disclosure, there is provided an image recording apparatus including:

a conveyer configured to convey a sheet in a first orientation;

a platen configured to support the sheet being conveyed by the conveyer;

a sensor configured to output a signal corresponding to presence or absence of the sheet supported by the platen;

a recording head having a plurality of ejection ports and configured to record an image on the sheet supported by the platen;

a memory; and a controller, wherein:

the controller is configured to store, in the memory, first identification information and a minimum margin value in a state that the first identification information and the minimum margin value are associated with each other, the first identification information being information for identifying a recorded image having been recorded on a recording surface of the sheet, the minimum margin value being a minimum value of partial image margins, along a second orientation intersecting the first direction, of a plurality of recorded partial images obtained by dividing the recorded image in the first orientation;

the controller is configured to obtain second identification information for identifying an image-to-be-recorded being an image planned to be recorded on the recording surface, and a plurality of partial images-to-be-recorded obtained by dividing the image-to-be-recorded in a first orientation; and in a case that the obtained second identification information is same as the first identification information stored in the memory, the controller is configured to determine whether the minimum margin value stored in the memory is smaller than a threshold value or not, and then:

in a case that the minimum margin value is smaller than the threshold value, the controller is configured to derive, by the sensor, an edge position in the second orientation of the sheet being conveyed by the conveyer, and then execute ejection of ink from the plurality of ejection ports based on the derived edge position in the second orientation of the sheet and the image-to-be-recorded; and in a case that the minimum margin value in not smaller than the threshold value, the controller is configured to execute the ejection of the ink from the plurality of ejection ports based on the image-to-be-recorded without deriving the edge position in the second orientation of the sheet being conveyed by the conveyer.

According to the above-described processing, in a case that an image-to-be-recorded which is same as an image which has been already recorded (recorded image) is to be recorded on the sheet, the minimum margin value (i.e., the minimum value) stored in the memory can be substituted for the minimum value of the margin in the image-to-be-recorded, even if the controller has not received all the margin information.

BRIEF DESCRIPTION OF THE DRAWINGS

FIGS. 6A and 6B are each a flow chart indicating a processing by an information processing apparatus 150, wherein FIG. 6A is a flow chart indicating a generating processing, and FIG. 6B is a flow chart indicating a transmitting processing.

FIG. 9 is a schematic view depicting data structure of a minimum margin DB 400.

EMBODIMENTS

Figure 1:
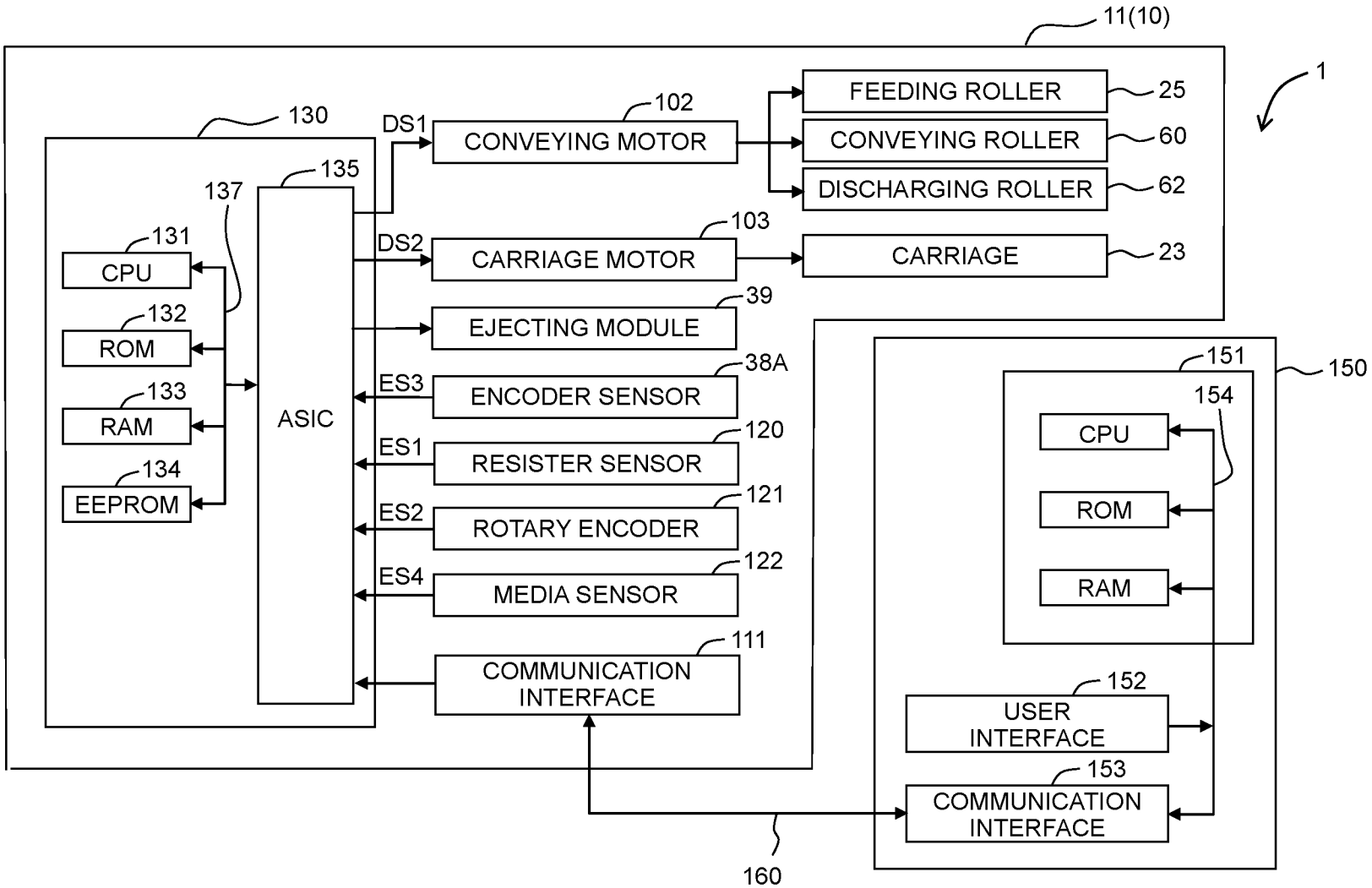
FIG. 1 is a block diagram depicting the configuration of a system 1.

In the following, an embodiment of the present disclosure will be explained, with reference to the drawings. It should be noted that the embodiment explained below is merely an example of the present invention; it is needless to say that the embodiment of the present invention can be appropriately changed as long as the gist of the present invention is not changed. In the following explanation, an up-down direction 7 is defined, with a state in which a multi-functional peripheral 10 is installed so as to be usable (the state depicted in FIG. 2) as the reference; a front-rear direction 8 is defined with a surface in which an opening 13 is provided as the front side (a front surface 17); and a left-right direction 9 is defined with the multi-functional peripheral 10 as seen from the front side (the side of the front surface 17). The up-down direction 7, the front-rear direction 8 and the left-right direction 9 are orthogonal to one another. In the following explanation, an advancement from the start point to the end point of an arrow is expressed as an "orientation", and going forth and back on a line connecting the start point and the end point of the arrow is expressed as a "direction". In other words, the orientation is a component of the direction.

<Overall Configuration of System 1>

In FIG. 1, a system 1 includes the multi-functional peripheral 10 and at least one information processing apparatus 150. The multi-functional peripheral 10 and the information processing apparatus 150 are capable of being in data communication with each other via a data transmitting route 160. The data transmitting route 160 is a communication network constructed of a wired LAN, a wireless LAN, a WAN, or combinations thereof. Alternatively, the data transmitting route 160 may be a USB cable. Note that it is sufficient that the multi-functional peripheral 10 is capable of at least receiving data from the information processing apparatus 150. In the following, the specific configurations of the multi-functional peripheral 10 and the information processing apparatus 150 will be explained in order.

<Overall Configuration of Multi-Functional Peripheral 10>

Figure 2:
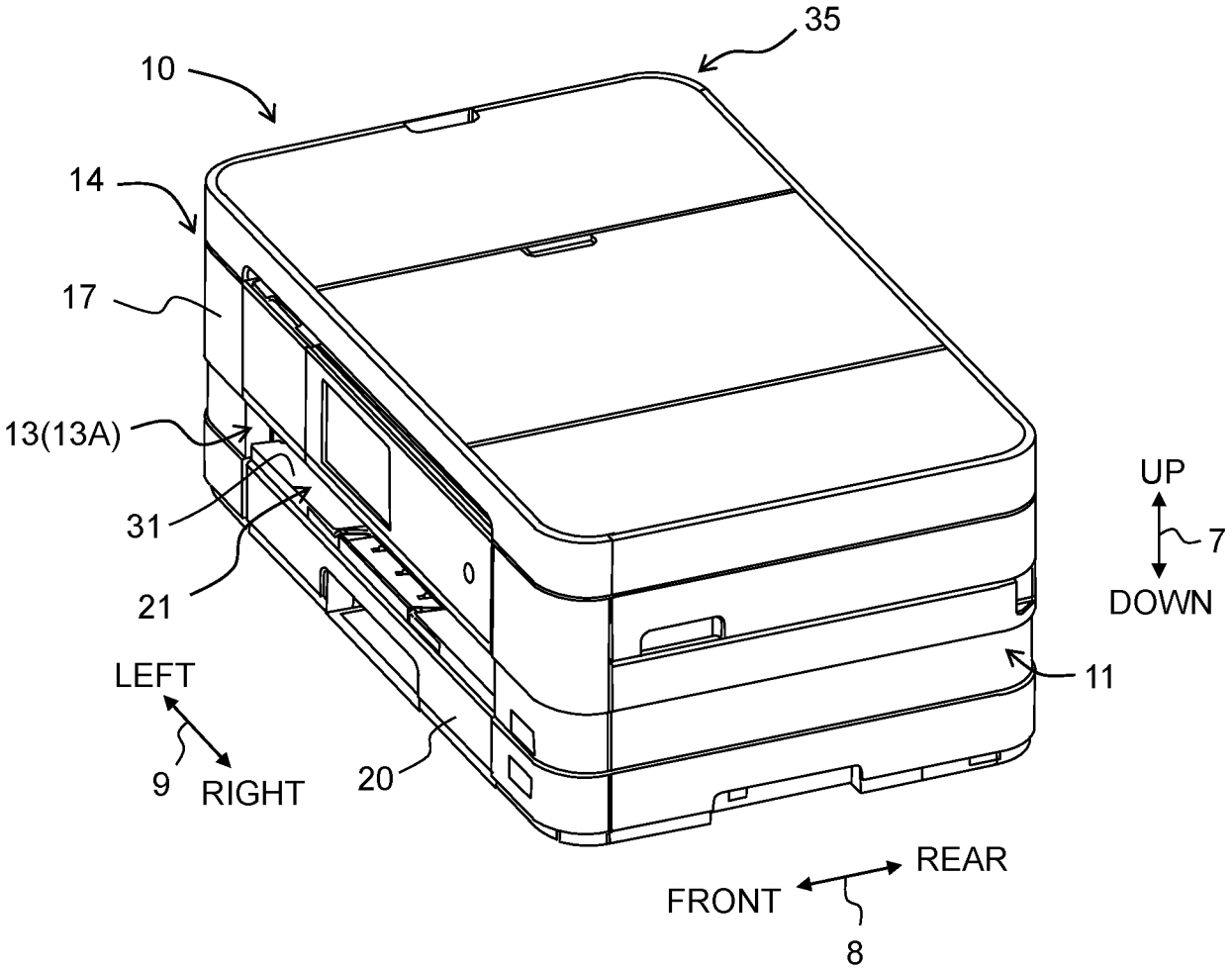
FIG. 2 is a perspective view of the outer appearance of a multi-functional peripheral 10.

In FIG. 2, the multi-functional peripheral 10 is an example of an image recording apparatus and has a plurality of functions including a printing function and a scanning function, etc. The multi-functional peripheral 10 includes a casing 14 having an outer shape which is substantially rectangular parallelepiped. The casing 14 includes an exterior body and a frame. The multi-functional peripheral 10 includes a scanner part 35 having the scanning function in an upper part of the casing 14, and a printer part 11 on a lower part of the casing 14. The printer part 11 has the printing function and records an image on a first surface (i.e., a recording surface) of a sheet 12 (see FIG. 3) in the ink-jet system. The sheet 12 is a sheet (paper sheet, paper), an OHP sheet, etc.

Figure 3:
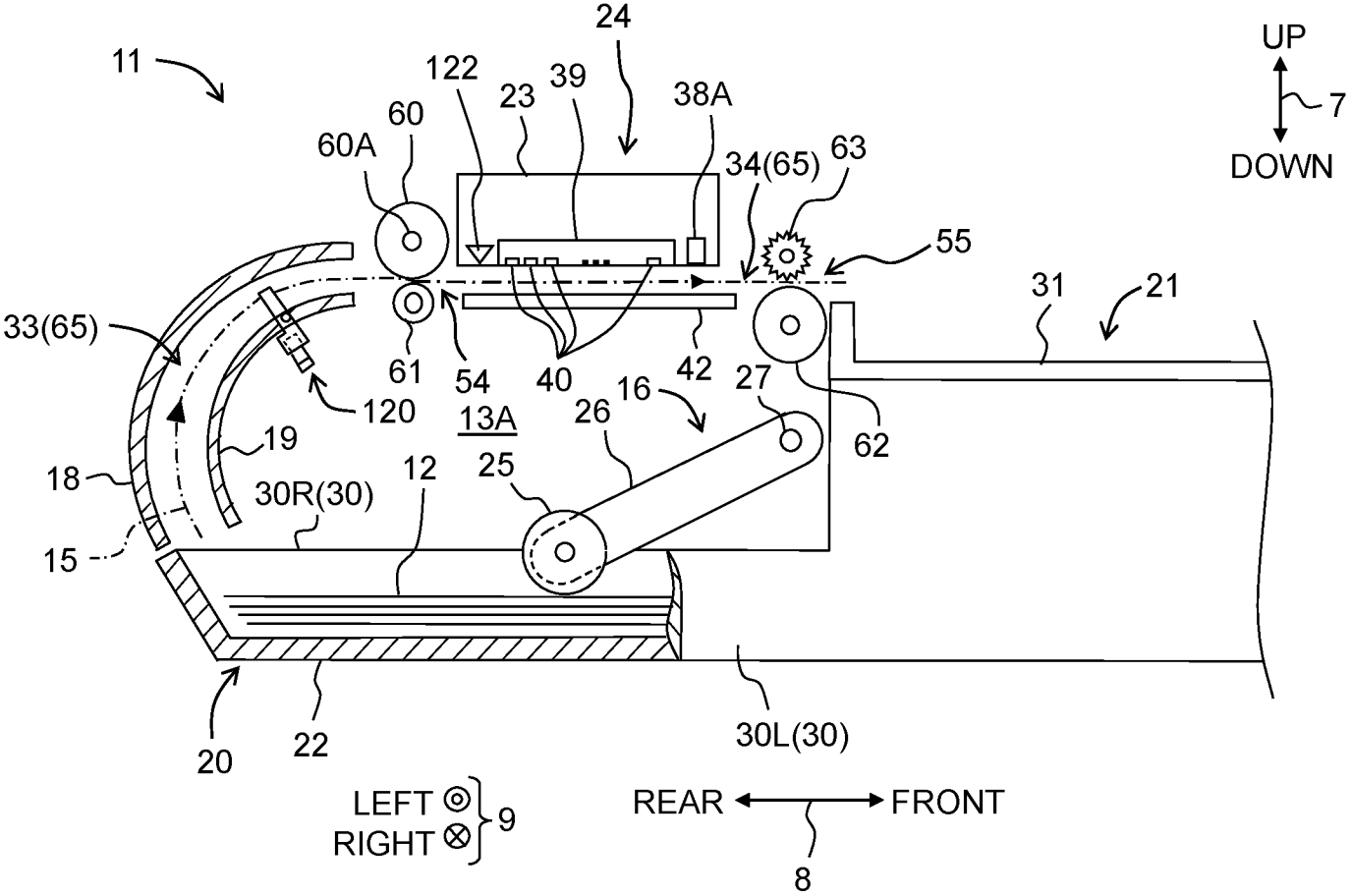
FIG. 3 is a vertical cross-sectional view schematically depicting the internal structure of a printer part 11.

As depicted in FIG. 3, the printer part 11 generally includes a supply tray 20, a discharge tray 21, a conveying mechanism 16, a conveying route 65, a conveying roller pair 54, a platen 42, a recording head 24, and a discharging roller pair 55.

<Supply Tray 20>

As depicted in FIG. 2, the opening 13 is formed in the front surface 17 of the casing 14. The opening 13 is opened towards the front side of the casing 14. As depicted in FIG. 3, an internal space 13A is formed in the casing 14 (see FIG. 2). The internal space 13A communicates with an external space of the casing 14 via the opening 13 (see FIG. 2).

In FIG. 2, the supply tray 20 is inserted into the internal space 13A (see FIG. 3) through the opening 13. The supply tray 20 moves on a guide rail (not depicted in the drawings) provided in the casing 14, rearward in the internal space 13A towards an install position and is installed in the casing 14 at the install position. The supply tray 20 moves on the guide rail (not depicted in the drawings), frontward from the install position, and is withdrawn or removed from the casing 14 through the opening 13. FIG. 2 and FIG. 3 depict the supply tray 20 positioned in the install position.

The supply tray 20 may be constructed so that the supply tray 20 is not removed from the casing 14 by a stopper (not depicted in the drawings) which is provided on a front end part of the guide rail.

As depicted in FIG. 2 and FIG. 3, the supply tray 20 has a shape of a box which is thin in the up-down direction 7. As depicted in FIG. 3, a part, of the supply tray 20, which is located near to an rear end of the supply tray 20 is opened upward.

The supply tray 20 includes a bottom wall 22 and a pair of side walls 30.

As depicted in FIG. 3, the bottom wall 22 supports a plurality of pieces of the sheet 12 in a state that the plurality of sheets 12 are stacked. In the stacked state, the recording surface of each of the plurality of sheets 12 faces (is oriented towards) the bottom wall 22 (i.e. downwards).

The pair of side walls 30 includes a left side wall 30L and a right side wall 30R. Note that FIG. 3 is a partial cross-sectional view. Specifically, in FIG. 3, the illustration of a part, of the left wall 30L, which is near to a rear end of the left side wall 30L is omitted, and only a part, of the right wall 30R, which is near to a rear end of the right side wall 30R is depicted. The left side wall 30L and the right side wall 30R are standing walls extending upwardly from a left end and a right end, respectively, of the bottom wall 22 and spread or extend in the up-down direction 7 and the front-rear direction 8.

The bottom wall 22 is provided with a pair of two side guides (not depicted in the drawings). One of the side guides moves in the left-right direction 9 by an operation by a user. The other of the side guides is mechanically connected to one of the side guides by a rack and pinion mechanism or the like. In conjunction with movement of one of the side guides in the left-right direction 9, the other of the side guides moves in a reverse orientation in the left-right direction 9. As a result, the center in a width direction of each of the plurality of sheets 12 is aligned with the center of the conveying route 65 in the left-right direction 9 (hereinafter also referred to as the "center in sheet passing").

The bottom wall 22 may be provided with one piece of a side guide (not depicted in the drawings), instead of the pair of two side guides. In such a case, the side guide is moved toward one side in the left-right direction 9 by the operation of the user, to cause each of the plurality of sheets 12 on the bottom wall 22 to make contact with (abut against) one of side walls 30, thereby aligning the center in the width direction of each of the plurality of sheets 12 with the center in sheet passing.

<Discharge Tray 21>

In FIG. 2, the discharge tray 21 supports, on an upper surface 31 of the discharge tray 21, the sheet 12 having an image recorded on the recording surface thereof. The discharge tray 21 is integral with the supply tray 20 and is provided between upper ends of the side walls 30 of the supply tray 20 (see FIG. 3). The discharge tray 21 is rotatably supported about an axis along the left-right direction 9, at the rear end part of the supply tray 20. This causes the discharge tray 21 to rotate (turn) between a closed position and an opened position. The closed position and the opened position are positions at which the discharge tray 21 closes and opens (releases), respectively, a space close to a front part in the supply tray 20. FIG. 2 and FIG. 3 depict the discharge tray 21 at the closed position. The user can move the sheet 12 in and out of the supply tray 20 in a case that the supply tray 20 is removed from the casing 14 and that the discharge tray 21 is at the open position.

In the following description, unless otherwise specified, respective axes are parallel to the left-right direction 9.

As depicted in FIG. 2 and FIG. 3, in a case that the supply tray 20 is at the install position, the upper surface 31 of the discharge tray 21 partitions the internal space 13A. The upper surface 31 supports the sheet 12 which is discharged by the discharging roller pair 55.

<Conveying Mechanism 16>

As depicted in FIG. 3, the conveying mechanism 16 is located between the bottom wall 22 at the install position and the platen 42 in the up-down direction 7. The conveying mechanism 16 generally includes a feeding roller 25 and a feeding arm 26. The feeding roller 25 is supported by a forward end part of the feeding arm 26 to be rotatable about the axis of the feeding roller 25. A base end part of the feeding arm 26 is located above and in front of (on the upper side and on the front side of) a forward end part of the feeding arm 26. The feeding arm 26 has a support shaft 27 in the base end part. The feeding arm 26 is supported by the frame of the casing 14 to be rotatable about the axis of support shaft 27.

The feeding arm 26 accommodates or stores a driving transmitting mechanism (not depicted in the drawings) in the inside of the feeding arm 26. The driving force transmitting mechanism includes a plurality of gears or an endless belt, and transmits the driving force of a conveying motor 102 (see FIG. 1) to the feeding roller 25. With this, the feeding roller 25 rotates in the forward direction and feeds or supplies an uppermost sheet 12, among the plurality of sheets 12 supported by the bottom wall 22, to the conveying route 65. A downward force is applied to the forward end part of the feeding arm 26 by the self-weight of the feeding arm 26 or a biasing force by a spring, etc. This causes the feeding roller 25 to press downward the sheet 12 on the bottom wall 22.

<Conveying Route 65>

As depicted in FIG. 3, the casing 14 has the conveying route 65 extending from a rear end of the supply tray 20 at the install position. The conveying route 65 is a conveying route for the sheet 12, with a so-called U-turn shape. The width in the left-right direction 9 of the conveying route 65 is slightly wider than the maximum width of the sheet 12 supported by the supply tray 20.

The conveying route 65 has a curved part 33 and a straight part 34.

The curved part 33 extends upwardly from the rear end of the supply tray 20 at the install position, and extends toward the front side. The curved part 33 is formed by an outer guide member 18 and an inner guide member 19. The outer guide member 18 and the inner guide member 19 are supported by the casing 14 (see FIG. 2), and have shapes which are long in the left-right direction 9, respectively. The outer guide member 18 is located at a spacing distance from the inner guide member 19. Specifically, a lower portion of the outer guide member 18 is located behind (on the rear side of) the inner guide member 19 and an upper portion of the outer guide member 18 is located above (on the upper side of) the inner guide member 19.

The outer guide member 18 and the inner guide member 19 are an example of a "first guide". The outer guide member 18 and the inner guide member 19 guide the sheet 12 fed from the supply tray 20 to the platen 42.

The straight part 34 is continuous with a downstream end of the curved part 33 and extends frontward generally linearly from the downstream end of the curved part 33 and arrives at a rear end of the discharge tray 21. The upper side of the straight part 34 is defined by a lower surface of the recording head 24 and the lower side of the straight part 34 is defined by an upper surface of the platen 42.

In FIG. 3, the sheet 12 is conveyed, in the conveying route 65, in a conveying orientation 15 indicated by an alternate long and short dash line. Specifically, in the curved part 33, the sheet 12 is conveyed to the conveying roller pair 54 while being guided mainly by the outer guide member 18. The sheet 12 is nipped by the conveying roller pair 54 which is rotating and is conveyed to the front side, in a state that the recording surface faces upward. In the straight part 34, the sheet 12 passes a location immediately below the recording head 24, while being supported on the upper surface of the platen 42. During this time, the ink is ejected or discharged from the recording head 24 onto the recording surface of the sheet 12. Namely, the recording head 24 records an image on the sheet 12 supported on the upper surface of the platen 42. As a result, the image is recorded on the recording surface. The sheet 12 is then conveyed to the discharging roller pair 55. The sheet 12 is nipped by the discharging roller pair 55 which is rotating, and is discharged to the upper surface 31 of the discharge tray 21 located at the front side of the discharging roller pair 55.

<Conveying Roller Pair 54>

As depicted in FIG. 3, the conveying roller pair 54 is located at the downstream end of the curved part 33 (i.e., at an upstream end of the straight part 34). The conveying roller pair 54 includes a conveying roller 60 and a pinch roller 61. The conveying roller 60 extends in the left-right direction 9 along the conveying route 65, at a location above the conveying route 65. The conveying roller 60 is rotated in the forward direction by the driving force generated in the conveying motor 102 (see FIG. 1). The pinch roller 61 makes contact with the conveying roller 60 from a location below the conveying roller 60, and is rotated following the rotation of the conveying roller 60. The sheet 12 is nipped by the conveying roller 60 rotating in the forward direction and the pinch roller 61 rotating following the rotation of the conveying roller 60, and is conveyed in the conveying orientation 15. Namely, the conveying roller pair 54 conveys the sheet 12 in the conveying orientation 15.

Note that the conveying roller pair 54 is a part of a "conveyer".

<Resister Sensor 120>

As depicted in FIG. 3, a resister sensor 120 is provided at a resister position near the downstream end of the curved part 33. The resister sensor 120 is supported by the inner guide member 19 and extends to the curved part 33. The resister sensor 120 is swingable (rockable), in the curved part 33, in the conveying orientation 15 and a reverse orientation which is reverse to the conveying orientation 15. The sheet 12 which is (being) conveyed in the curved part 33 makes contact with the resister sensor 120. As depicted in FIG. 1, the resister sensor 120 outputs, to the controller 130, an electric signal ES1 having a level corresponding to a contact force applied from the sheet 12 to the resister sensor 120. The electric signal ES1 indicates the presence or absence of the sheet 12 at the resister position.

<Rotary Encoder 121>

In FIG. 3, the conveying roller 60 is supported on the casing 14 (see FIG. 2) via a shaft 60A which rotates about the axis thereof. The rotary encoder 121 (see FIG. 1) is provided in the vicinity of the shaft 60A. The rotary encoder 121 has an encoder disk and an encoder sensor. The encoder disk is attached to the shaft 60A and rotates together with the shaft 60A. The encoder disk has a plurality of through holes which are arranged side by side with a spacing distance therebetween in a circumferential direction of the axis of the shaft 60A. The encoder sensor includes a light-emitting element and a light-receiving element. The rotary encoder 121 emits a light from the light-emitting element toward the plurality of through holes of the encoder disk which is rotating. The light-receiving element faces the light-emitting element with the encoder disk interposed therebetween, and is capable of receiving the light emitted from the light-emitting element. As depicted in FIG. 1, the rotary encoder 121 outputs an electric signal ES2, corresponding to an amount of the received light, from the light-receiving element to the controller. The electric signal ES2 is a pulse signal and indicates the rotation rate of the conveying roller 60.

<Platen 42>

Figure 4:
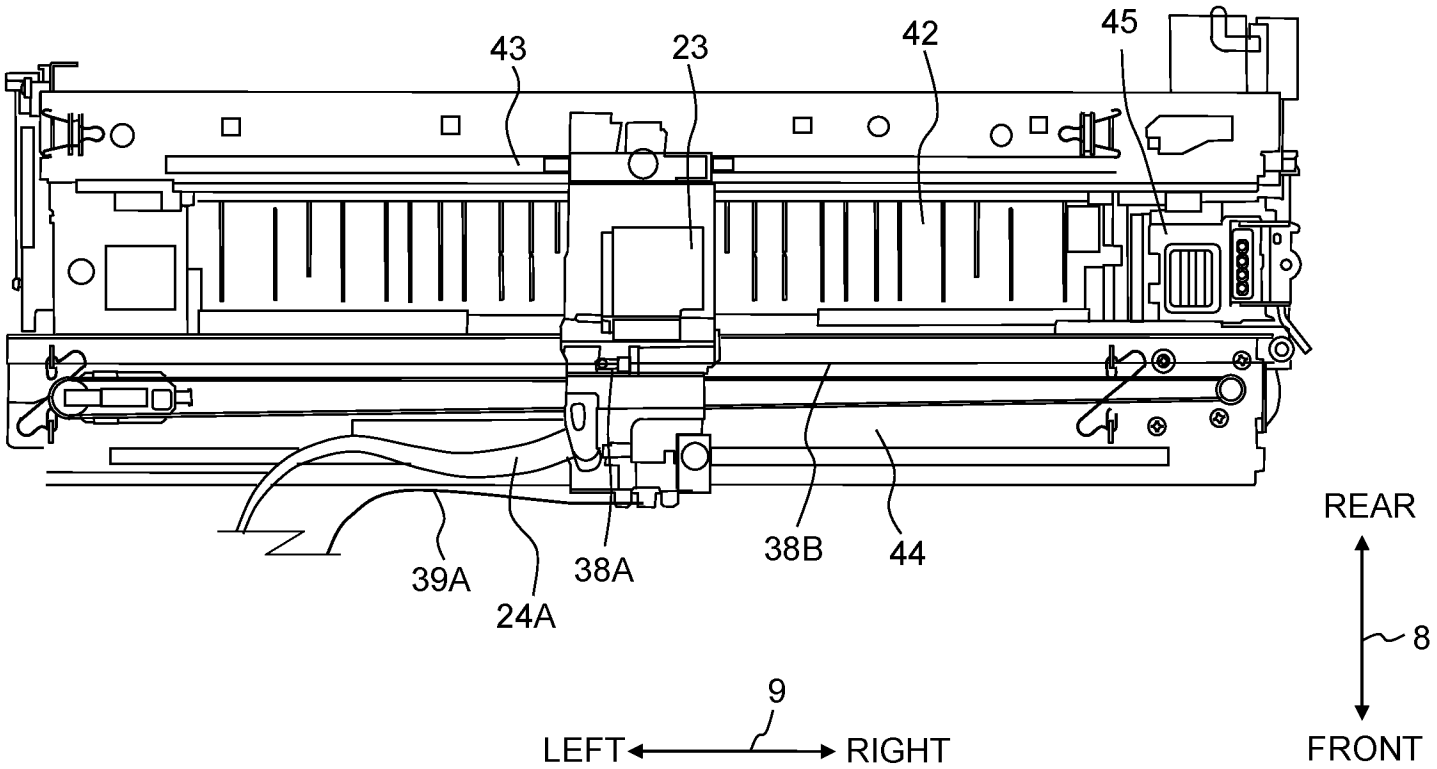
FIG. 4 is a plan view of a carriage 23 and guide rails 43 and 44.

In FIG. 3 and FIG. 4, the platen 42 has a supporting surface (see FIG. 4) which extends or spreads in the front-rear direction 8 and the left-right direction 9, at a location immediately below the straight part 34, at a position between the conveying roller pair 54 and the discharging roller pair 55 in the conveying orientation 15 (see FIG. 3). In other words, the platen 42 supports the sheet 12 which is (being) conveyed by the conveying roller pair 54. The supporting surface of the platen 42 is positioned along the lower side of the straight part 34 (see FIG. 3). Further, the supporting surface of the platen 42 is, for example, colored in black to thereby allow the supporting surface to have a light reflectance smaller than the light reflectance of the sheet 12.

<Recording Head 24>

As depicted in FIG. 3, the recording head 24 is spaced or away upwardly from the platen 42 and includes a carriage 23, an ejecting module (discharging module, ejector) 39, an encoder sensor 38A and a media sensor 122. The ejecting module 39, the encoder sensor 38A and the media sensor 122 are communicably connected to a controller 130 (see FIG. 1) through a flexible flat cable 24A (see FIG. 4). Further, the ejecting module 39 is connected to an ink container (not depicted in the drawings) such as an ink tank, an ink cartridge, etc., via an ink tube 39A (see FIG. 4) so that they are in fluid communication with each other.

The carriage 23 is much smaller than the platen 42 in terms of the size in the left-right direction 9, as depicted in FIG. 4. The carriage 23 is supported by a pair of two guide rails 43 and 44. The guide rails 43 and 44 extend in the left-right direction 9 along the platen 42 at positions which are apart from each other in the front-rear direction 8 with the platen 42 being interposed therebetween. The carriage 23 is placed to span across the guide rails 43 and 44 and is moved in the left-right direction 9 along the guide rails 43 and 44 by a driving force transmitted from a publicly known belt conveying mechanism.

The belt conveying mechanism generally includes two pieces of pulleys and an endless belt. The two pieces of pulleys are separated away from each other in the left-right direction 9 in the guide rail 44. The endless belt is stretched over the two pieces of pulleys and are connected to the carriage 23. The driving force generated by the carriage motor 103 (see FIG. 1) is transmitted to one of the two pieces of pulleys. As the one of the two pieces of pulleys rotates in the forward direction and the backward direction, the endless belt transmits the driving force in the left-right direction 9 to the carriage 23, and the carriage 23 moves reciprocally between the two pieces of pulleys in the left-right direction 9. Specifically, in a case that the carriage motor 103 rotates forward, the carriage 23 moves in the leftward orientation, and in a case that the carriage motor 103 rotates backward, the carriage 23 moves to the rightward orientation.

Figure 5A:
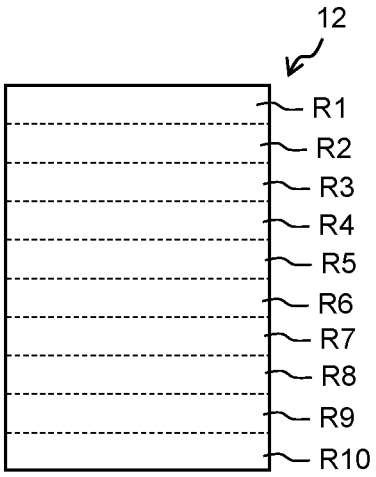
FIG. 5A depicts unit areas R1 to R10 in a sheet 12.

As depicted in FIG. 3, the ejecting module 39 is attached to the side of a lower surface of the carriage 23. A plurality of ejecting ports 40 are formed in the lower surface of the ejecting module 39. Under the control of the controller 130, the ejecting module 39 ejects or discharges the ink supplied from an ink container (not depicted in the drawings) via the ink tube 39A (see FIG. 4) in a process during which the carriage 23 moves in each of the leftward orientation and the rightward orientation. With this, an image is recorded on the recording surface of the sheet 12. In the following, an area, of the sheet 12, in which the image is recorded per each process in which the carriage 23 moves leftward or per each process in which the carriage 23 moves rightward is referred to as a "unit area". In an example depicted in FIG. 5A, ten pieces of unit areas R1 to R10 in the recording surface of the sheet 12 are depicted.

An encoder strip 38B extending in the left-right direction 9 is provided on the guide rail 44. The encoder sensor 38A is mounted on the carriage 23 and faces the encoder strip 38B on the front side or on the rear side with respect to the encoder strip 38B. The encoder sensor 38A is an encoder sensor including a light-emitting element and a light-receiving element. The encoder sensor 38A emits a light from the light-emitting element toward the encoder strip 38B during a process during which the carriage 23 reciprocally moves. The encoder sensor 38A receives a reflected light of the light reflected off from the encoder strip 38B by the light-receiving element. The encoder sensor 38A outputs, from the light-receiving element to the controller 130, an electric signal ES3 (see FIG. 1) corresponding to a light receiving amount of the light received by the encoder sensor 38A. The electric signal ES3 indicates a position in the left-right direction 9 of the carriage 23.

<Discharging Roller Pair 55>

In FIG. 3, the discharging roller pair 55 is located at a position which is close to an downstream end in the straight part 34 and which is between the recording head 24 and the discharge tray 21 which is located at an install position, in the conveying orientation 15. The discharging roller pair 55 includes a discharging roller 62 and a spur 63. The discharging roller 62 extends in the left-right direction 9 along the conveying route 65, at a location on a lower side of the conveying route 65. The discharging roller 62 is rotated in the forward direction by a driving force generated in the conveying motor 102 (see FIG. 1). The spur 63 makes contact with the discharging roller 62 from the position above the discharging roller 62 and is rotated following the discharging roller 62 by the rotation of the discharging roller 62. The sheet 12 is nipped between the discharging roller 62 rotating in the forward direction and the spur 63 following the rotation of the discharging roller 62, and is conveyed in the conveying orientation 15.

Note that the discharging roller pair 55 is another part of the conveyer.

<Media Sensor 122>

In FIG. 3, the media sensor 122 is attached to a lower surface (a surface facing the platen 42) of the carriage 23. The media sensor 122 includes a light-emitting element and a light-receiving element. The media sensor 122 emits, from the light-emitting element, a light of a predetermined light amount downwardly (namely, toward the platen 42 or toward the sheet 12 on the platen 42). The media sensor 122 receives, by the light-receiving element, a reflected light of the light reflected off from the platen 42 or the sheet 12, and outputs, to the controller 130, an electric signal ES4 (see FIG. 1) corresponding to a light receiving amount of the light received by the light-receiving element. In other words, the media sensor 122 outputs a signal corresponding to the presence or absence of the sheet 12 supported by the platen 42. The electric signal ES4 indicates the presence or absence of the sheet 12 in the platen 42.

The media sensor 122 is an example of a "sensor".

<Communication Interface 111>

As depicted in FIG. 1, the multi-functional peripheral 10 includes a communication interface 111 (hereinafter also referred to as a "communication I/F 111"). The communication I/F 111 is an interface for performing data communication with the information processing apparatus 150 via the data transmitting route 160.

<Controller 130>

As depicted in FIG. 1, the controller 130 include a CPU 131, a ROM 132, a RAM 133, an EEPROM 134, and an ASIC 135 which are connected by an internal bus 137. The ROM 132 stores a program, etc., for controlling the operation(s) of the multi-functional peripheral 10. The CPU 131 executes the program by using the RAM 133 and/or the EEPROM 134.

Note that the controller 130 is an example of a "controller". The RAM 133 and the EEPROM 134 are an example of a "memory".

The ASIC 135 is electrically connected to the conveying motor 102 and the carriage motor 103. The ASIC 35 generates driving signals DS1 and DS2 for rotating the conveying motor 102 and the carriage motor 103, respectively, and outputs the driving signals DS1 and DS2 to the conveying motor 102 and the carriage motor 103, respectively. The ASIC 135 is electrically connected to the resister sensor 120, the rotary encoder 121, the encoder sensor 38A and the media sensor 122 and receives the electric signals ES1, ES2, ES3 and ES4, from the resister sensor 120, the rotary encoder 121, the encoder sensor 38A and the media sensor 122, respectively.

<Information Processing Apparatus 150>

As depicted in FIG. 1, the information processing apparatus 150 is, for example, a PC (Personal Computer), a smartphone, a tablet terminal, and include a controller 151, a user interface 152 (hereinafter also referred to as a "user IF 152"), and a communication I/F 153.

The controller 151 include a CPU, a ROM, a RAM, etc.

The user I/F 152 includes a display, a mouse, etc. The display is a liquid crystal display, an organic EL display, etc., and displays a variety of kinds of information. The mouse accepts or receives an input by a user.

The controller 151, the user I/F 152 and the communication I/F 153 are connected to one another by an internal bus 154 so that the controller 151, the user I/F 152 and the communication I/F 153 are capable of communicating with one another.

Note that the configurations of the controller 151, the communication I/F 153 and the internal bus 154 are similar to the configurations of the controller 130, the communication I/F 111 and the internal bus 137 of the multi-functional peripheral 10, and therefore the explanations therefor will be omitted.

<Operation of System 1>

In the following, a processing of recording (recording processing) in which the multi-functional peripheral 10 records an image on the sheet 12 based on a recording instruction outputted from the information processing apparatus 150, with reference to FIGS. 1 to 11.

<Processing by Information Processing Apparatus 150>

First, a processing by the information processing apparatus 150 will be explained with reference to FIGS. 6A and 6B.

Figure 6A:
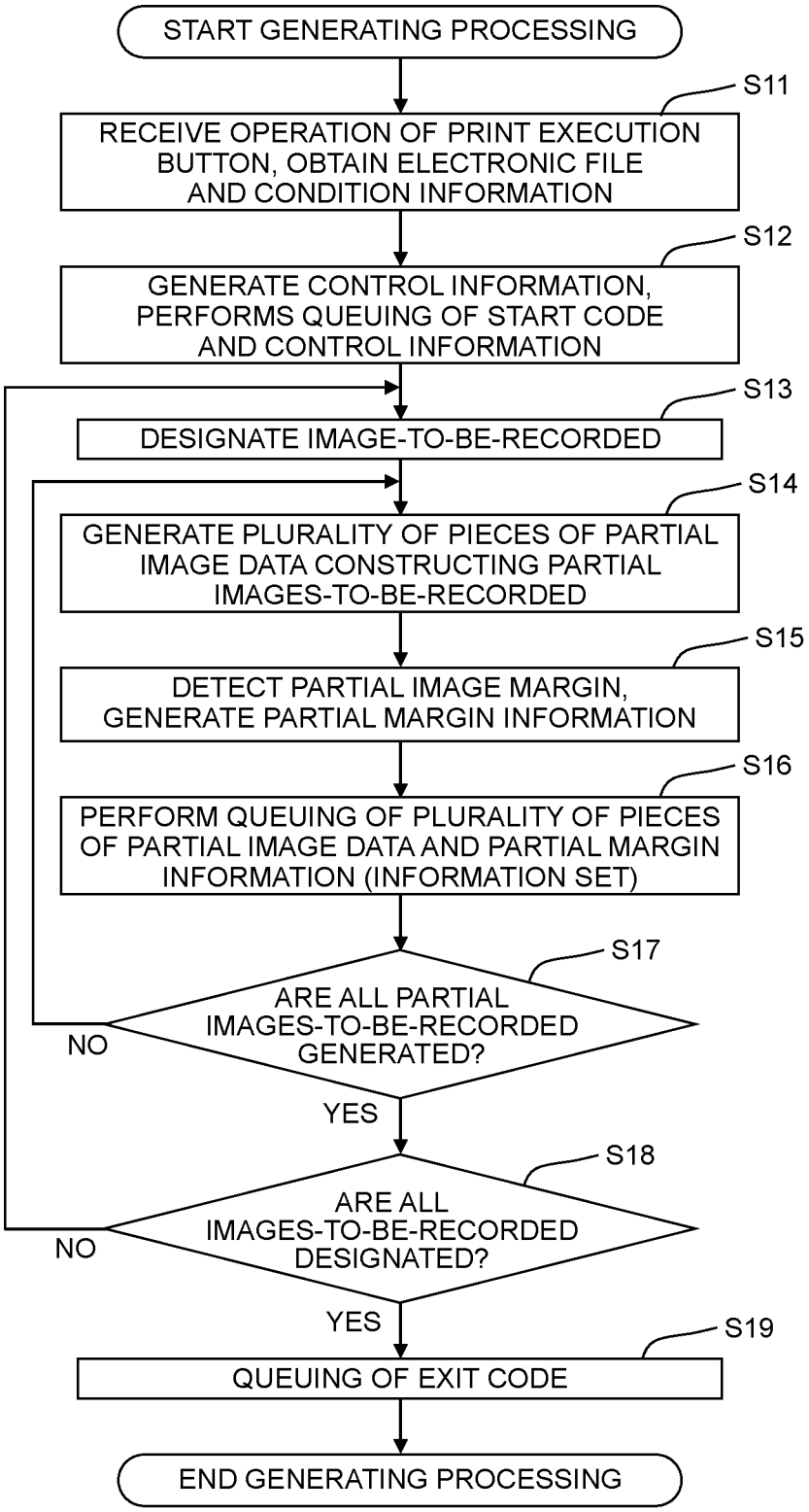

The controller 151 executes the program stored in the ROM thereof to thereby start a generating processing of generating record instruction information as depicted in FIG. 6A. The controller 151 receives, via the mouse of the user I/F 152, an operation of a print execution button displayed on the display, and obtains an electronic file and condition information (step S11 in FIG. 6A).

The electronic file includes one or plurality of pieces of image data. The plurality pieces of image data indicate images-to-be-recorded, respectively. Each of the images-to-be-recorded is an image which is to be recorded on the recording surface of the sheet 12 in the multi-functional peripheral 10. Each of the images-to-be-recorded includes values of a plurality of pixels arranged in a matrix form in a first orientation 15A and a second orientation 9A (see FIG. 5C). The values of the plurality of pixels indicate colors of the pixels, respectively. The first orientation 15A is an orientation from a forward end toward a rear end in the conveying orientation 15 of the sheet 12. The second orientation 9A is an orthogonal orientation which is orthogonal to the first orientation 15A.

In a case that the electronic file includes a plurality of pieces of the image data, the electronic file further includes a plurality of pieces of recording order information associated with the images-to-be-recorded, respectively. Each of the plurality of pieces of recording order information indicates a recording order being an order in which an image-to-be-recorded corresponding to the recording order information is to be recorded on the sheet 12. The recording order is a page number, etc.

Figure 5B:
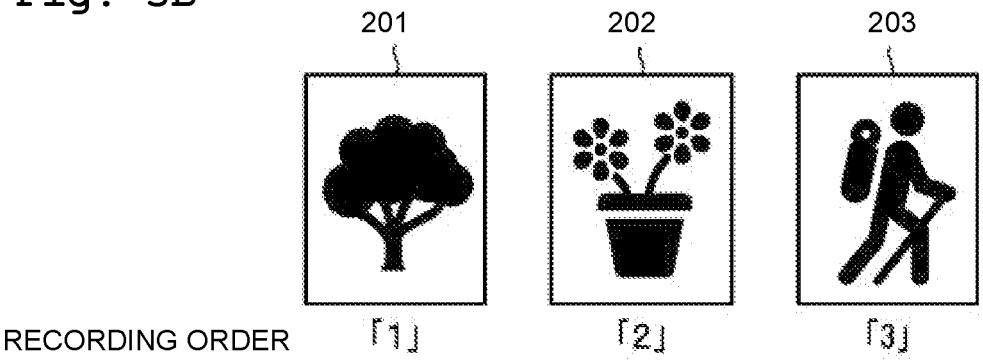
FIG. 5B depicts three images-to-be-recorded 201 to 203.

FIG. 5B exemplify three images-to-be-recorded 201 to 203, and "1" to "3" as the recording order of the images-to-be-recorded 201 to 203, corresponding to one piece of electronic file 200.

The condition information indicates a condition (hereinafter also referred to as a "recording condition") under which each of the images-to-be-recorded is to be recorded by the multi-functional peripheral 10. The recording condition is the size of the sheet 12 (hereinafter also referred to as a "sheet size"), the resolution of an image to be recorded on the sheet 12, etc.

<Generating Processing>

Regarding the execution of step S11 as a trigger, the controller 151 executes step S12 and steps thereafter. The record instruction information is a so-called a print job and indicates an instruction for instructing the multi-functional peripheral 10 to record the image-to-be-recorded on the sheet 12.

In step S12, the controller 151 generates control information. The control information includes, for each of the images-to-be-recorded, second identification information and a number of a partial image-to-be-recorded. The control information further includes the condition information obtained in step S11.

Figure 5C:
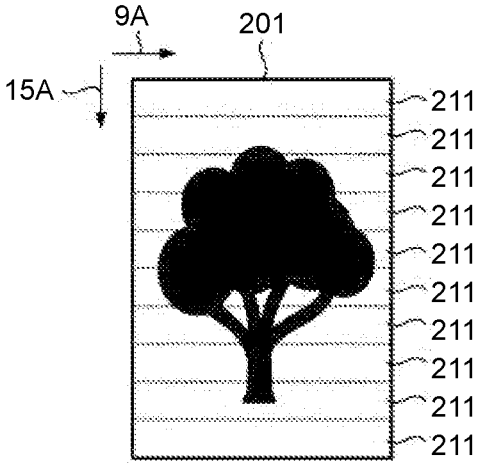
FIG. 5C depicts 10 pieces of a partial image-to-be-recorded 211.

The second identification information is information for identifying the corresponding image-to-be-recorded which is, for example, a combination of a name of the electronic file (namely, a file name) and the recording order information. The second identification information may be the name of the print job instead of the file name The number of the partial image-to-be-recorded is information indicating a number of the partial images-to-be-recorded constructing the corresponding image-to-be-recorded. Each of the partial images-to-be-recorded are obtained by dividing the image-to-be-recorded in the first orientation 15A (see FIG. 5C.). The sizes in the first orientation 15A and the second orientation 9A (see FIG. 5C) of each of the partial images-to-be-recorded correspond to the unit area. Each of the partial images-to-be-recorded is recorded on the sheet 12, which is being conveyed in the conveying orientation 15, in an order along the first orientation 15A. As a result, each of the partial images-to-be-recorded is recorded in a unit area corresponding thereto in the sheet 12. Note that FIG. 5C depicts an example in which the image-to-be-recorded 201 is divided into 10 pieces of partial images-to-be-recorded 211. Further, in FIG. 5C, each of broken lines is an imaginary line indicating the boundary between partial images-to-be-recorded 211 which are adjacent in the first orientation 15A.

The controller 151 divides the size of the image recording area in the sheet 12, having a sheet size included in the recording condition, by size of the unit area, etc., to thereby derive the number of the partial image-to-be-recorded.

In step S12, the controller 151 further performs queuing, to a print queue, of a start code of the record instruction information and the control information. The print queue is a recording area allocated in the RAM.

In step S13, the controller 151 designates one of undesignated image-to-be-recorded from one or a plurality of pieces of the image-to-be-recorded obtained in step S11. Next, in step S14, the controller 151 sequentially generates a plurality of pieces of partial image data indicating the plurality of the partial images-to-be-recorded, with the image-to-be-recorded designated in step S13 as an object of the processing.

Each of the plurality of pieces of partial image data has a bitmap format, etc. Also, in each of the plurality of pieces of partial image data, the value of each of the pixels is denoted by a YMCK value. Note that the image data may be of the bitmap format, or may be of another format (e.g., JPEG format). In a case that the image data is of another format, then in step S14, the plurality of pieces of partial image data are generated after the image data has been converted to the bitmap format. Furthermore, in the image data, the value of each of the pixels is indicated by RGB; thus, in step S14, the value of each of the pixels is converted from the RGB value to the YMCK value.

Every time the controller 151 completes the generation of one piece of the partial image data in S14, the controller 151 detects, in step S15, a margin of the partial image (partial image margin), with the partial image-to-be-recorded indicated by the generated partial image data, as the object of the processing. In step S15, the controller 151 further generates partial margin information indicating the size of the detected partial image margin.

The method of detecting the partial image margin in step S15 is, for example, as follows. The controller 151 counts, for each row (array) of pixels aligned in the second orientation 9A in the partial image-to-be-recorded as the object of the processing, a number of pixels from a pixel on one end in the second orientation 9A until first appearance, in the second orientation 9A, of a pixel having a value different from the white. The controller 151 also counts a number of pixels from a pixel on the other end in the second orientation 9A until first appearance of a pixel having the value different from the white, in a reverse orientation of the second orientation 9A. The controller 151 generates the partial margin information indicating the minimum value of pixels, among the counted numbers of the pixels, as the size of the partial image margin. In other words, there is such a case that the partial image-to-be-recorded has the partial image margins, respectively, on both of the side of the one end and the side of the other end in the second orientation 9A. The size of the partial image margin is the minimum value of a width of the margin (margin width) in the second orientation 9A of the partial image margin.

In step S16, the controller 151 performs queuing, to the print queue, of an information set which is a combination of the plurality of pieces of the partial image data generated in step S14 and the partial margin information generated in step S15.

Next, in step S17, the controller 151 determines whether or not the generation of all the partial images-to-be-recorded, from the image-to-be-recorded as the object of the processing, has been completed. In a case that the controller 151 determines that the generation has not been completed, the controller 151 executes step S14; in a case that the controller 151 determines that the generation has been completed, the controller 151 executes step S18.

In step S18, the controller 151 determines whether or not all of the images-to-be-recorded are designated. In a case that the all of the images-to-be-recorded have not been designated, the controller 151 executes step S13. On the other hand, in a case that the all of the images-to-be-recorded have been designated, the controller 151 performs, in step S19, queuing, to the print queue, of an exit code of the record instruction information, and ends the generating processing.

<Transmitting Processing>

Figure 6B:
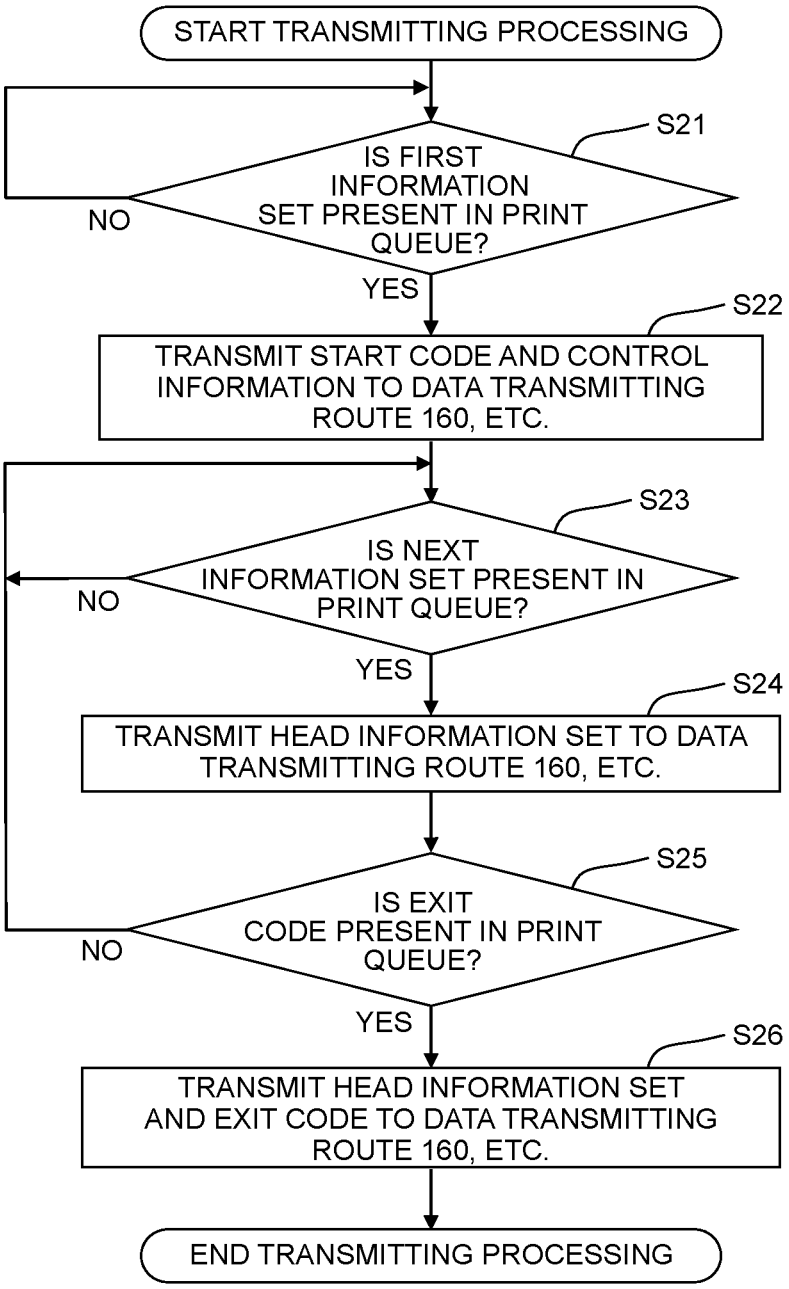

The controller 151 executes a transmitting processing indicated in FIG. 6B, in parallel with the generating processing. The transmitting processing includes steps S21 to S26.

After the controller 151 has started the generating processing, the controller 151 periodically executes step S21. In step S21, the controller 151 determines whether or not a first information set is present in the print queue. In a case that the controller 151 determines that the first information set is not present in the print queue, the controller 151 returns to step S21 and stands by until a next execution timing. On the other hand, in a case that the controller 151 determines that the first information set is present in the print queue, the controller 151 transmits, from the print queue, in step S22, the start code and the control information to the communication I/F 153 sequentially in the FIFO (First In First Out) system, and then the controller 151 erases the start code and the control information from the print queue. The communication I/F 153 sends the received start code and control information to the data transmitting route 160.

Note that in the following description, the processing such as step S22, namely, a series of processings of "the controller 151 transmits information from the print queue to the communication I/F 153 in the FIFO system; the controller 151 erases the information; and the communication I/F 153 sends the received information to the data transmitting route 160" is described while being simplified as "the controller 151 transmits head (leading) information in the print queue to the data transmitting route 160".

After step S22, the controller 151 periodically executes step S23. In step S23, the controller 151 determines whether or not a next information set is present in the print queue. In a case that the controller 151 determines that the next information set is not present in the print queue, the controller 151 returns to step S23 and stands by until a next execution timing. On the other hand, in a case that the controller 151 determines that the next information set is present in the print queue, the controller 151 transmits, in step S24, a head information set in the print queue to the data transmitting route 160.

After step S24, the controller 151 periodically executes step S25. In step S25, the controller 151 determines whether or not the exit code is present in the print queue. In a case that the controller 151 determines that the exit code is not present in the print queue, the controller 151 returns to step S23 and stands by until a next execution timing. On the other hand, in a case that the controller 151 determines that the exit code is present in the print que, the controller transmits, in step S26, the head information set and the exit code in the print queue sequentially to the data transmitting route 160, and ends the transmitting processing.

Figure 5D:
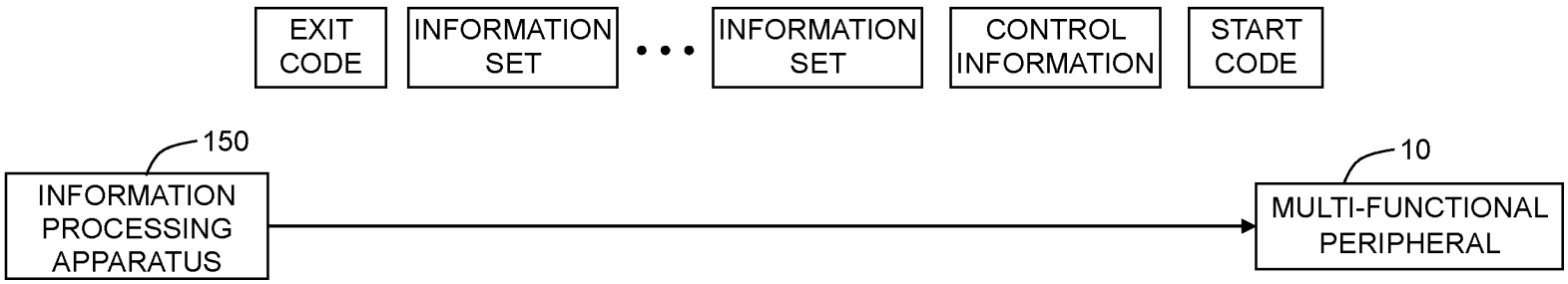
FIG. 5D is a schematic view depicting record instruction information.

As a result of the transmitting processing, on the data transmitting route 160, the record instruction information containing the start code, the control information, the plurality of information sets, the exit code as depicted in FIG. 5D is transmitted to the multi-functional peripheral 10 in a sequential manner <Image Recording Processing by Multi-Functional Peripheral 10>

Next, a processing by the multi-functional peripheral 10 will be explained, with reference to FIGS. 7A, 7B, 7C, 8A and 8B.

The EEPROM 134 stores a minimum margin value data base 400 depicted in FIG. 9 (hereinafter also referred to as a "minimum margin DB 400"). The controller 130 executes step S333 (to be explained later) to thereby store, in the minimum margin DB 400, first identification information and minimum margin value while being associated with each other. Information in which the first identification information and the minimum margin value are associated with each other is an example of a specifying information.

The first identification information is information for identifying a recorded image which is an image recorded, on the recording surface of the sheet 12, in the multi-functional peripheral 10. Further, the first identification information is also information for identifying an image-to-be-recorded which is planned to be recorded on the recording surface of the sheet 12. The first identification information is a combination of the file name and the recording order information (information about an order of recording), of the electronic file indicating the recorded image.

The recorded image, similarly to the image-to-be-recorded, contains values of a plurality of pixels arranged in a matrix shape. The recorded image is recorded on the recording surface of the sheet 12 by a unit of a recorded partial image, similarly to the partial image-to-be-recorded. Thus, each of a plurality of pieces of the recorded partial image has a partial image margin similarly to that of the partial image-to-be-recorded. The minimum margin value indicates the minimum value of margin widths in the plurality of pieces of the recorded partial image.

Figure 7A:
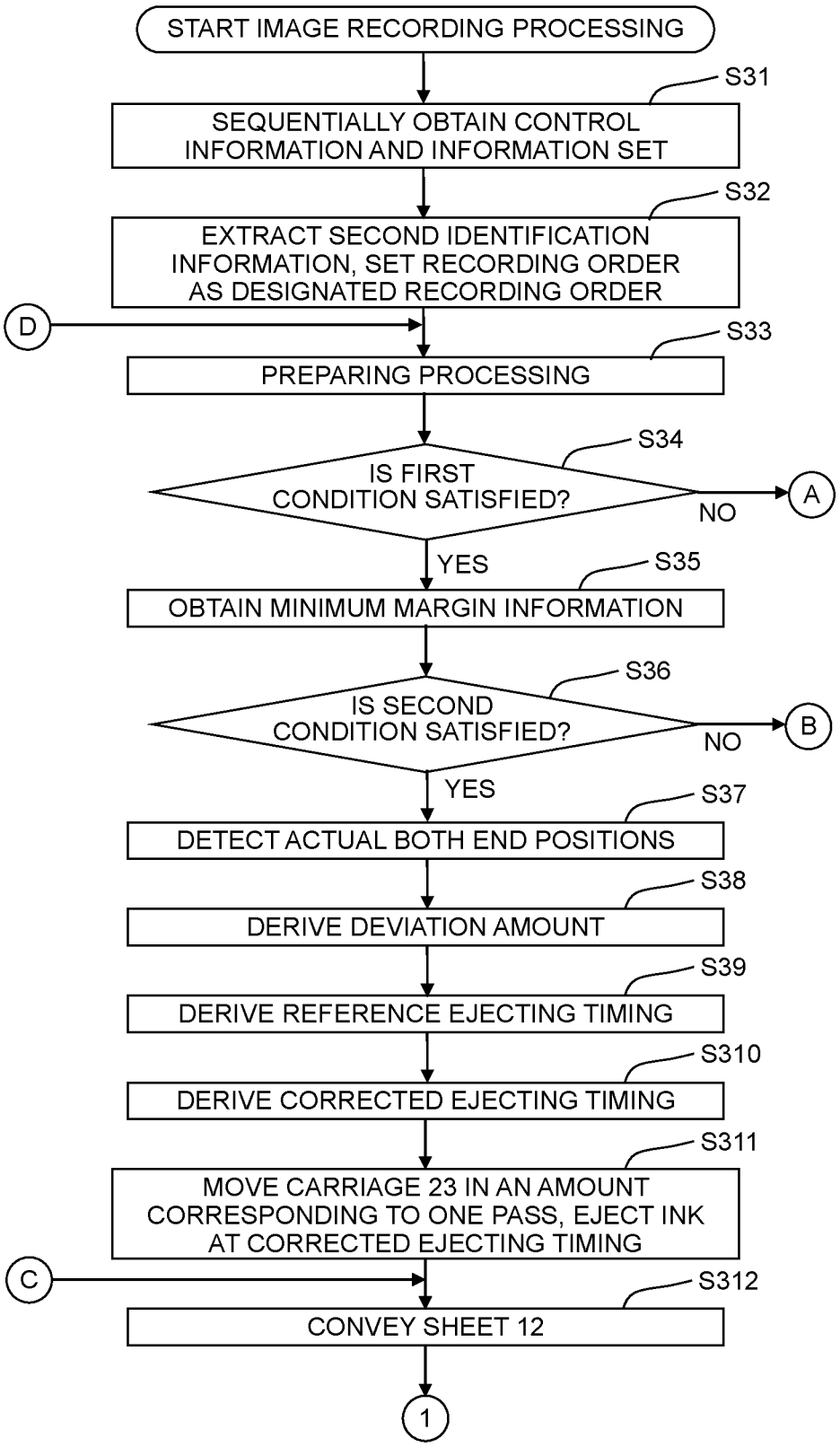
FIGS. 7A, 7B, and 7C depict a flow chart indicating a first half of an image recording processing in the multi-functional peripheral 10.
Figure 7B:
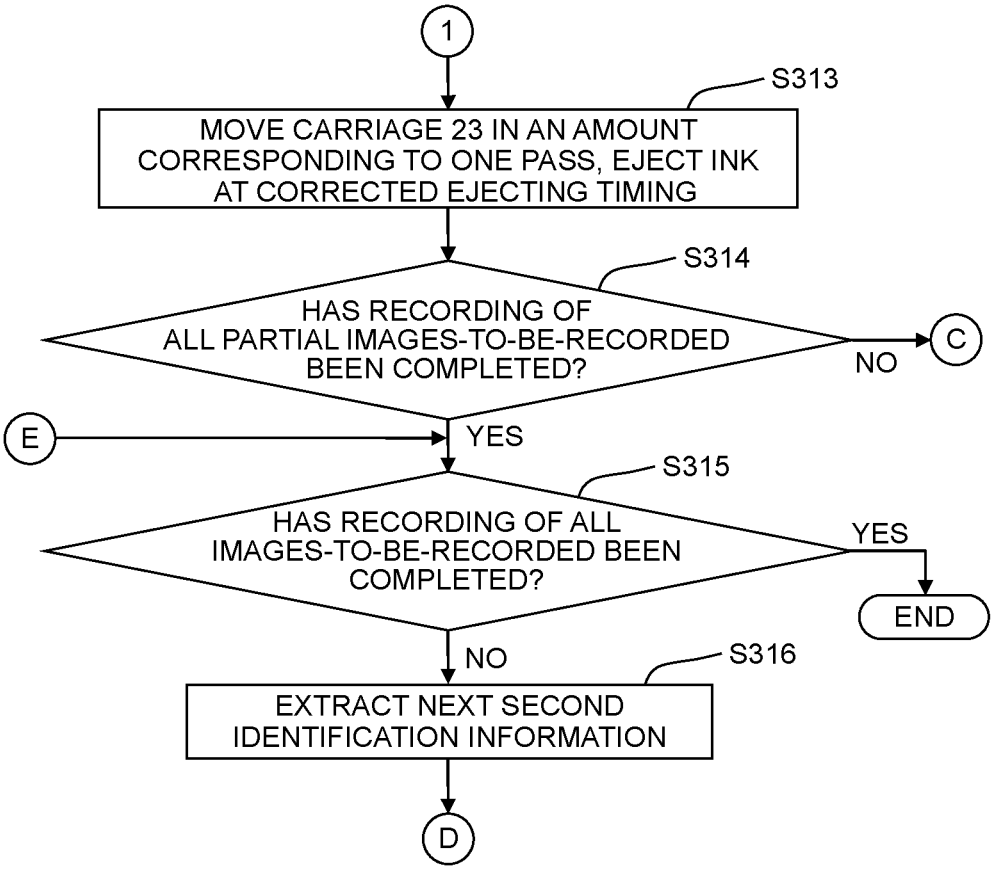
Figure 7C:
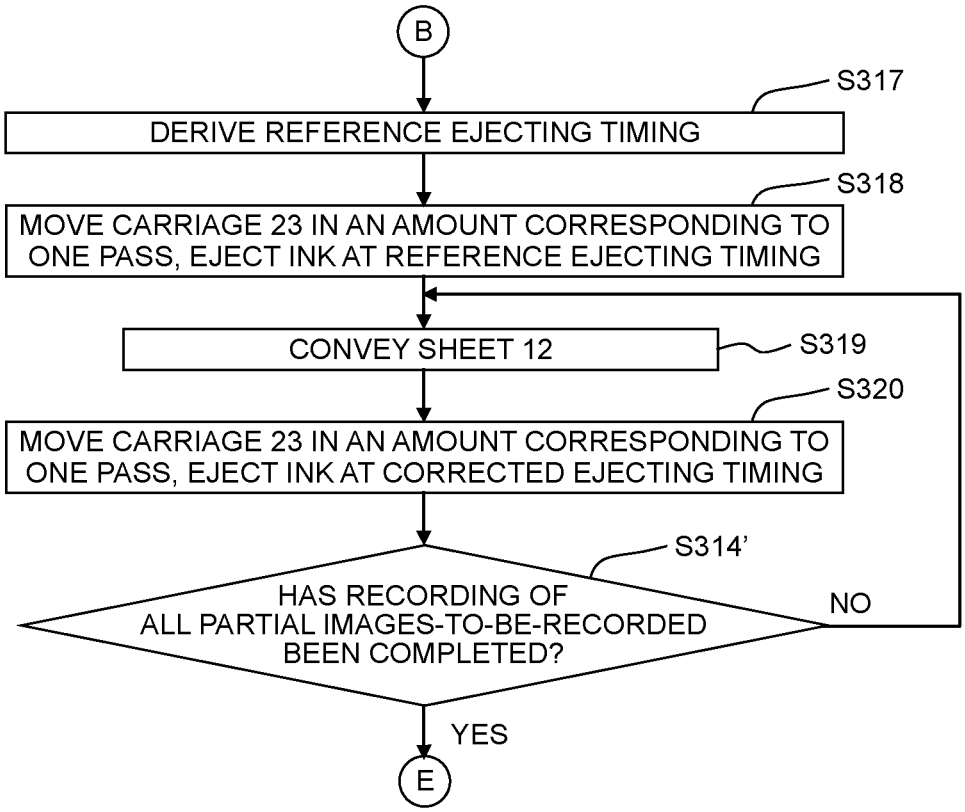

The controller 130 is executing the program stored in the ROM 132, and the controller 130 executes an image recording processing of step S31 and steps thereafter as depicted in FIGS. 7A to 7C, with reception of the start code included in the record instruction information as a trigger.

In step S31, the controller 130 sequentially obtains the control information and the information set. Specifically, the controller 130 sequentially transmits to and stores in the RAM 133, the start code, the control information, the information set, and the exit code sequentially received from the communication I/F 111. A plurality of pieces of the image-to-be-recorded are stored in the RAM 133 in a recording order by which the plurality of pieces of the image-to-be-recording are to be recorded. The plurality of pieces of the partial image-to-be-recorded constructing each of the images-to-be-recorded are stored in the RAM 133 in an order along the first orientation 15A.

In step S32, the controller 130 extracts second identification information including a first recording order from the control information obtained in step S31. In step S32, the controller 130 further sets the recording order included in the extracted second identification information as a designated recording order.

In step S33, the controller 130 executes a preparing processing for allowing the recording head 24 to eject or discharge the ink to the sheet 12. The preparing processing includes a cueing processing, a flushing processing, etc.

The cueing processing is a processing of conveying, to a recording start position, a sheet 12 which is of the uppermost layer among the sheets 12 in the supply tray 20. The recording start position is a position at which a first unit area among the unit areas in the sheet 12 conveyed in the curved part 33 (see FIG. 3) is made to face or to be opposite to the plurality of ejecting ports 40 (see FIG. 3) at a location below the plurality of ejecting ports 40. The first unit area is a unit area in which a first partial image-to-be-recorded is to be recorded.

In the cueing processing, the controller 130 rotates the feeding roller 25 forward, and the feeding roller 25 feeds out the sheet 12 of the uppermost layer on the supply tray 20 to the conveying route 65. The controller 130 rotates the feeding roller 25 forward until a forward end in the conveying orientation 15 of the sheet 12 reaches a nip of the conveying roller pair 54. The controller 130 then rotates the conveying roller 60 and the discharge roller 62 forward until the first unit area reaches the recording start position.

Note that the controller 130 periodically receives the electric signals ES1 and ES2 (see FIG. 1). The controller 130 specifies or identifies a head position of the sheet 12 in the conveying route 65 by a change in a level of the electric signal ES1 and/or a number of pulses (pulse number) of the electric signal ES2.

In the flushing processing, the controller 130 forcibly discharges the ink from the plurality of ejecting ports 40 to an ink receiver 45 (see FIG. 4) located on the right side with respect to the platen 42.

Step S33 is executed in a state that all the information sets have not been stored in the RAM 133 in S31, in order to shorten FPOT (First Print Out Time) and ESAT (Estimated SAturated Throughput). That is, the controller 130 executes step S33 in parallel with step S31.

In step S34, the controller 130 searches the minimum margin DB 400 so as to determine whether or not a first condition is satisfied. In other words, the controller 130 determines whether or not specifying information is stored in the EEPROM 134. The first condition is a condition that the first identification information which matches or is same as the second identification information extracted in step S32 or step S316 is stored in the minimum margin DB 400. In a case that the first condition is satisfied, the controller 130 executes step S35. On the other hand, in a case that the first condition is not satisfied, the controller 130 executes S321. Namely, in a case that the specifying information is stored in the EEPROM 134, the controller 130 executes step S35. On the other hand, in a case that the specifying information is not stored in the EEPROM 134, the controller 130 executes step S321.

In step S35, the controller 130 obtains, from the minimum margin DB 400, minimum margin value which is stored while being associated with the first identification information matched in the search performed in step S34.

In step S36, the controller 130 determines whether or not a second condition is satisfied. The second condition is a condition that the minimum margin value obtained in step S35 indicates a value smaller than a margin threshold value. Here, in a case that an image-to-be-recorded having a small margin width is recorded on the sheet 12, any positional deviation of the image-to-be-recorded with respect to the recording surface is easily noticeable or conspicuous. Therefore, in a case that the second condition is satisfied, the controller 130 executes step S37. On the other hand, in a case that the controller 130 determines that the second condition is not satisfied, the controller 130 executes step S317. In other words, in a case that the first identification information which matches (which is same as) the second identification information extracted in step S32 or step S316 is stored in the minimum margin DB 400, the controller 130 determines whether or not the minimum margin value obtained in step S35 indicates a value smaller than the margin threshold value. In a case that the minimum margin value obtained in step S35 indicates the value smaller than the margin threshold value, the controller 130 derives, by the media sensor 122, a position of an end part (edge) of the sheet 12 which is (being) conveyed by the conveying roller pair 54, and then executes the ejection of the ink from the plurality of ejecting ports 40 based on the image-to-be-recorded. On the other hand, in a case that the minimum margin value obtained in step S35 does not indicate the value smaller than the margin threshold value, the controller 130 executes the ejection of the ink from the plurality of ejection ports 40 based on the image-to-be-recorded, without deriving the position of the end part of the sheet 12 which is (being) conveyed by the conveying roller pair 54. Namely, in a case that the second identification information extracted in step S32 or step S316 is same as the first identification information stored in the minimum margin DB 400, the controller 130 determines whether or not the minimum margin value stored in the minimum margin DB 400 is smaller than the margin threshold value; in a case that the minimum margin value is smaller than the margin threshold value, the controller 130 derives, with the media sensor 122, the position of the end part (edge) of the sheet 12 which is (being) conveyed by the conveying roller pair 54, and then executes the ejection of the ink from the plurality of ejecting ports 40 based on the derived position of the end part (edge) of the sheet 12 and the image-to-be-recorded. On the other hand, in a case that the minimum margin value is not smaller than the margin threshold value, the controller 130 executes the ejection of the ink from the plurality of ejection ports 40 based on the image-to-be-recorded, without deriving the position of the end part (edge) of the sheet 12 which is (being) conveyed by the conveying roller pair 54. Note that in a case that the association of the first identification information with the minimum margin value is stored in the EEPROM 134, the controller 130 determines whether or not the minimum margin value obtained in step S35 is a value smaller than the margin threshold value. In a case that the minimum margin value obtained in step S35 is the value smaller than the margin threshold value, the controller 130 derives, by the media sensor 122, the position of the end part of the sheet 12 which is (being) conveyed by the conveying roller pair 54. In a case that the minimum margin value obtained in step S35 is not the value smaller than the margin threshold value, the controller does not derive, by the media sensor 122, the position of the end part of the sheet 12 which is (being) conveyed by the conveying roller pair 54.

In step S37, the controller 130 detects positions of the both ends (both end positions) in the left-right direction 9 of the sheet 12 on the platen 42. In the following, the detected both end positions are also referred to as "actual both end positions". Specifically, the controller 130 causes each of the media sensor 122 and the encoder sensor 38A to emit the light. In this state, the controller 130 moves the carriage 23 to at least one of the left-right direction 9 between the left and right ends of the platen 42. During the movement of the carriage 23, the controller 130 receives the electric signals ES3 and ES4. The controller 130 makes the positions, indicated by the electric signal ES3 received at a timing at which the absolute value of an amount of the change in a level (level change amount) of the electric signal ES4 is not less than a level threshold value, as the actual both end positions. Namely, the controller 130 derives the position of the end part of the sheet 12 based on the output signals from the media sensor 122 and the encoder sensor 38A, respectively, during the movement of the carriage 23.

In step S38, the controller 130 derives a difference of the actual both end positions with respect to a reference both end position (an example of a "reference position"), as a deviation amount. The reference both end positions are the both end positions in the left-right direction 9 of the sheet 12 in a case that the center in the width direction of the sheet 12 is located at the center in sheet passing on the platen 42. The controller 130 stores or derives the reference both end positions for each of the sheet sizes in advance.

In step S39, the controller 130 derives a reference ejecting timing. The reference ejecting timing is an ink ejecting timing in a case wherein it is assumed that the respective partial images-to-be-recorded constructing the image-to-be-recorded of the designed recording order, are to be recorded in a sheet 12 located in the reference both end positions.

In step S310, the controller 130 derives a corrected ejecting timing. The corrected ejecting timing is an ink ejecting timing obtained by shifting the reference ejecting timing derived in step S39 by an amount corresponding to the deviation amount derived in step S38.

In step S311, the controller 130 drives the ejecting module 39 based on the first partial image data while moving the carriage 23 in an amount corresponding to one pass along the left-right direction 9, and causes the ink to be ejected from the ejection ports 40 of the ejecting module 39 at the corrected ejecting timing (an example of a "first timing"). With this, one partial image-to-be-recorded constructing the image-to-be-recorded of the designated recording order, is recorded in a first unit area of the sheet 12. In step S311, the controller 130 further erases the recorded partial image-to-be-recorded from the RAM 133.

In step S312, the controller 130 conveys the sheet 12 on the platen 42 to a next image recording position at which a next unit area faces the plurality of ejecting ports 40 (see FIG. 3) at a location below the plurality of ejecting ports 40.

In step S313, the controller 130 drives the ejecting module 39 based on next partial image data while moving the carriage 23 in the left-right direction 9 in an amount corresponding to one pass, and the controller 130 causes the ejecting module 39 to eject the ink at the corrected ejecting timing, thereby recording the next partial image-to-be-recorded in the next unit area of the sheet 12. Also in step S313, the recorded partial image-to-be-recorded is erased.

In step S314, the controller 130 determines whether or not recording, on the sheet 12, of all the partial images-to-be recorded constructing the image-to-be-recorded of the designated recording order, has been completed. In a case that the recording of all the partial images-to-be-recorded on the sheet 12 has not been completed, the controller 130 executes step S312. On the other hand, in a case that the recording of all the partial images-to-be-recorded on the sheet 12 has been completed, the controller 130 executes step S315.

In step S315, the controller 130 determines whether or not the recording of all the images-to-be-recorded included in the record instruction information on the sheet 12 has been completed. In a case that the recording of all the images-to-be-recorded on the sheet 12 has not been completed, the controller 130 executes step S316. On the other hand, in a case that the recording of all the images-to-be-recorded on the sheet 12 has been completed, the controller 130 ends the image recording processing.

In step S316, the controller 130 extracts the second identification information including a next recording order from the control information obtained in step S31. In step S316, the controller 130 further sets the recording order included in the extracted second identification information as the designated recording order. Afterwards, the controller 130 executes the processings of S33 to S315, etc.

In a case that the controller 130 determines in step S36 that the second condition is not satisfied, then in step S317, the controller 130 derives the reference ejecting timing, similar to step S39. In steps S318 to S320, the controller 130 executes processings which are different from steps S311 to S313 as follows: the difference is that the controller 130 ejects or discharges the ink from the ejection ports 40 of the ejecting module 39 at the reference ejecting timing (an example of a "second timing"). The controller 130 executes step S314' after step S320. In step S314', the controller 130 determines whether not recording, on the sheet 12, of all the partial images-to-be-recorded constructing the image-to-be-recorded, which is to be recorded in the designed recording order, has been completed. In a case that the recording of all the partial images-to-be-recorded on the sheet 12 has not been completed, the controller 130 executes step S319. On the other hand, in a case that the recording of all the partial images-to-be-recorded on the sheet 12 has been completed, the controller 130 executes steps S315 and S316 etc., in a similar manner as in the case that the controller 130 determines, in step S314, that the recording of all the partial images-to-be-recorded on the sheet 12 has been completed.

Figure 8A:
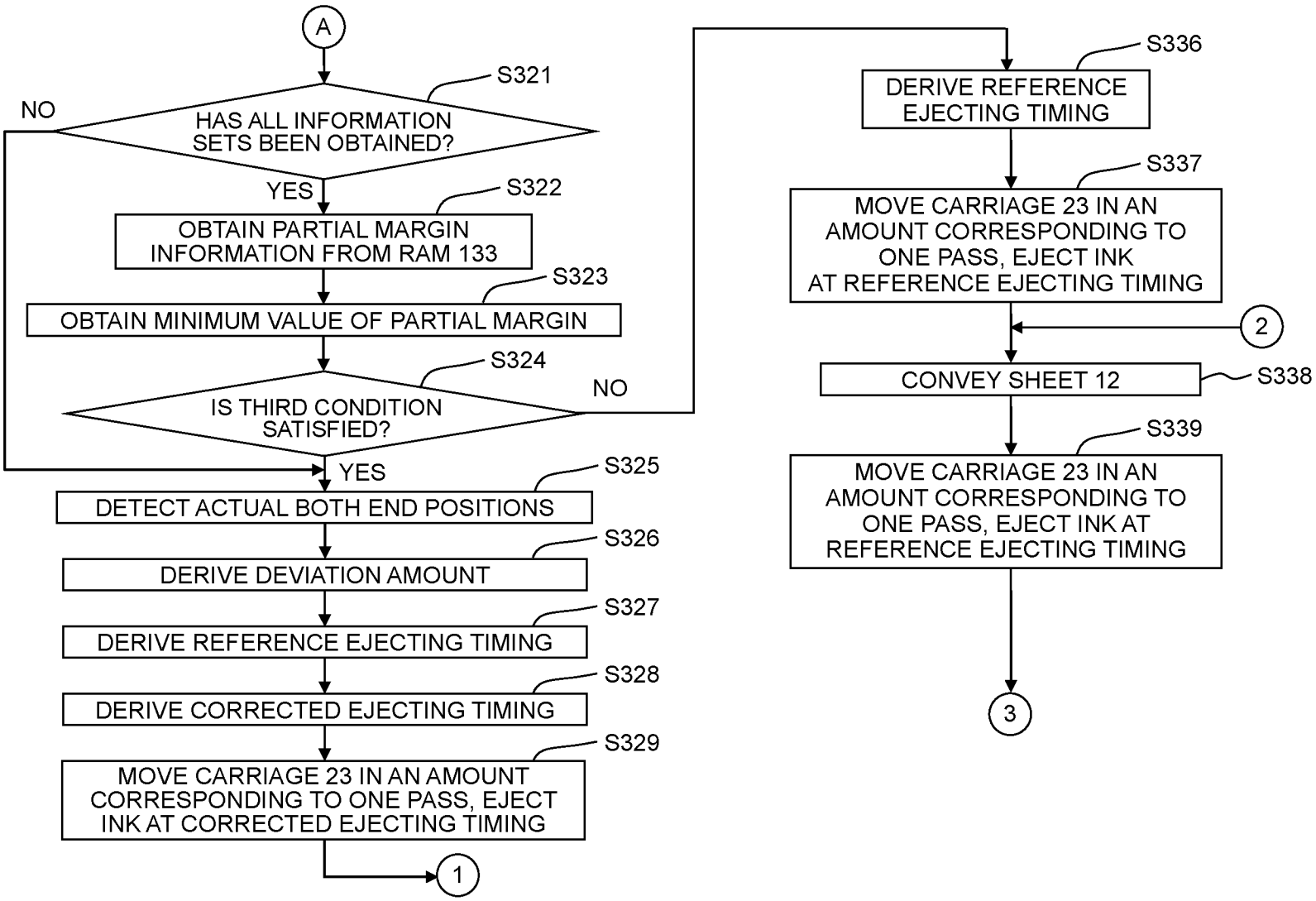
FIGS. 8A and 8B depict a flow chart indicating a latter half of the image recording processing in the multi-functional peripheral 10.
Figure 8B:
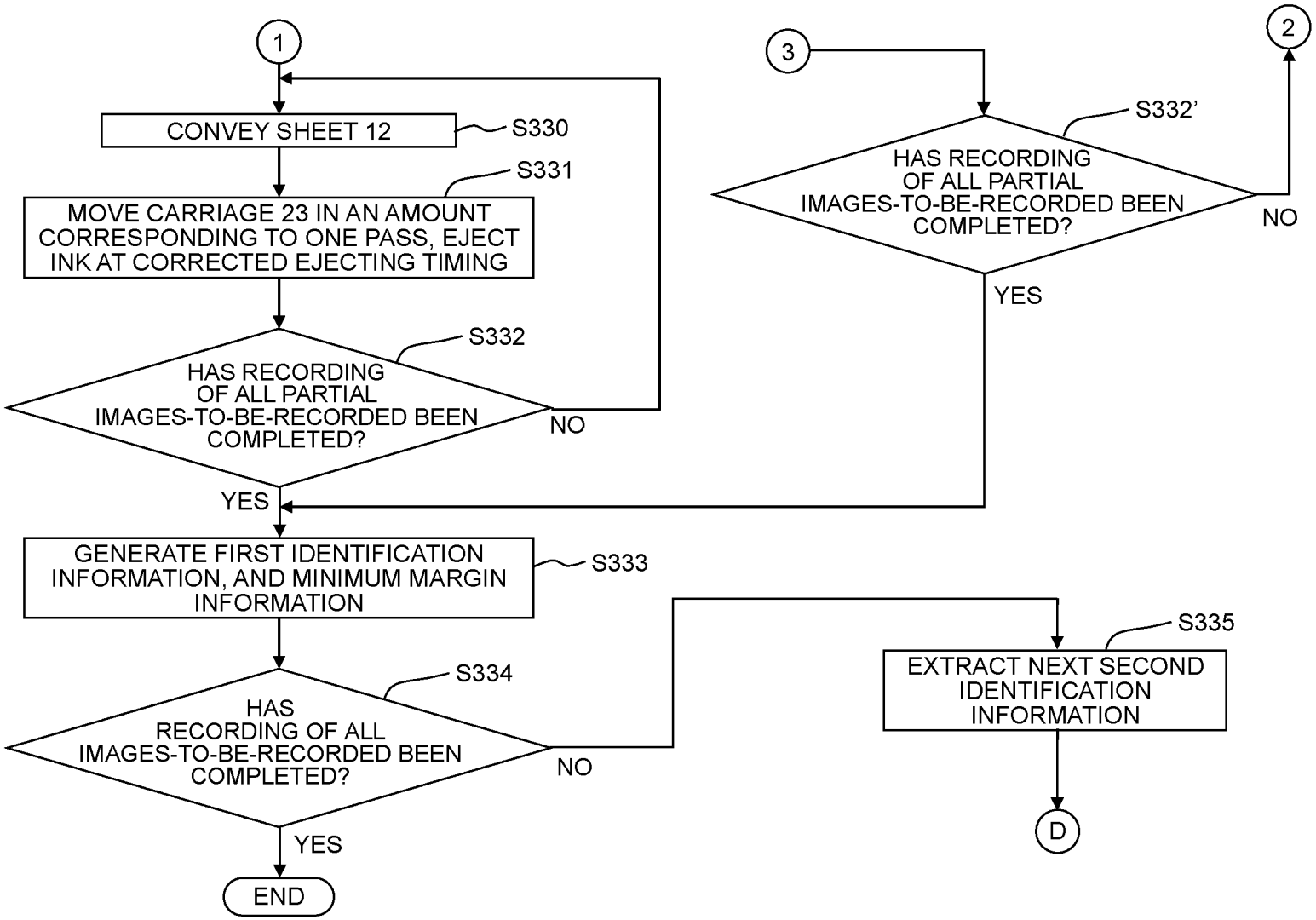

In step S321 of FIGS. 8A and 8B, the controller 130 determines whether or not all the information sets stored in the RAM 133 at the point of time of starting the execution of step S321 have been obtained. Specifically, the controller 130 determines whether or not the number of the information sets (i.e., the partial images-to-be-recorded) in the RAM 133 is not less than a number of the partial images-to-be-recorded included in the control information. In other words, the controller 130 determines whether or not all the partial images-to-be-recorded are stored in the RAM 133. The controller 130 executes step S322 in a case that the controller 130 determines that the all the information sets have been obtained; whereas the controller 130 executes step S325 in a case that the controller 130 determines that all the images-to-be-recorded have not been obtained. In other words, in a case that the controller 130 determines that all the partial images-to-be-recorded are not stored in the RAM 133, the controller derives, with the medias sensor 122, the position of the end part of the sheet 12 which is (being) conveyed by the conveying roller pair 54.

Note that it is allowable to execute step S321 in response to the completion of the preparing processing of step S33. Namely, it is allowable to execute step S321 in either one of: immediately after the controller 130 made determination of NO in step S34; and after the controller made the determination of NO in step S34 and after a predetermined time is elapsed since the controller 130 has completed the execution of step S33.

In step S322, the controller 130 obtains the partial margin information from all the information sets for the images-to-be-recorded of the designated recording order.

In step S323, the controller 130 obtains a minimum value of the partial margin from the obtained partial margin information.

In step S324, the controller 130 determines whether or not a third condition is satisfied. The third condition is a condition that the minimum value of the partial margin obtained in step S323 indicates a value smaller than the margin threshold value. In a case that the third condition is satisfied, the controller 130 executes step S325. Namely, in a case that the controller 130 determines that at least one of the partial image margins in the images-to-be-recorded is smaller than the threshold value, the controller 130 derives, with the media sensor 122, the position of the end part (edge) of the sheet 12 which is (being) conveyed by the conveying roller pair 54, and then executes the ejection of the ink from the plurality of ejection ports 40. On the other hand, in a case that the controller 130 determines that the third condition is not satisfied, the controller 130 executes step S336. Namely, in a case that all of the partial image margins in the images-to-be-recorded are not smaller than the threshold value, the controller 130 causes the ink to be ejected from the plurality of ejection ports 40, based on the predetermined reference position without detecting, with the media sensor 122, the position of the end part (edge) of the sheet 12 which is (being) conveyed by the conveying roller pair 54.

In steps S325 to S332, the controller 130 executes processings which are similar to those in steps S37 to S314, respectively. In particular, in step S329, the controller 130 causes the ink to be ejected from the ejection ports 40 of the ejecting module 39 at the corrected ejecting timing (an example of a "third timing"), in a similar manner as in step S311. In step S332, in a case that the recording of all the partial images-to-be-recorded on the sheet 12 has not been completed, the controller 130 executes step S330. On the other hand, in a case that the recording of all the partial images-to-be-recorded on the sheet 12 has been completed, the controller 130 executes step S333.

In step S333, the controller 130 generates (newly) first identification information and minimum margin value. Then, the controller 130 stores the first identification information in the EEPROM 134. The first identification information includes the file name, and the designated recording order stored in the RAM 133. The minimum margin value indicates the minimum value of the partial margin obtained in step S323. Further in step S333, the controller 130 stores the generated first identification information and minimum margin value in the minimum margin DB 400 while associating the generated first identification information and minimum margin value with each other to be used in a future image recording processing.

In step S334, the controller 130 performs processing which is similar to that in step S315. In a case that the recording of all the images-to-be-recorded on the sheet 12 has not been completed, the controller 130 executes step S335. On the other hand, in a case that the recording of all the images-to-be-recorded on the sheet 12 has been completed, the controller 130 ends the image recording processing.

In step S335, the controller 130 executes a processing which is similar to that in step S316, and executes the processings of step S33 and thereafter.

In steps S336 to S339, the controller 130 executes processings which are similar to those in steps S317 to S320, and the controller 130 executes step S332' after executing step S339. In a case that the all the partial images-to-be-recorded on the sheet 12 has not been completed in step S332', the controller 130 executes step S338. On the other hand, in a case that the recording of all the partial images-to-be-recorded on the sheet 12 has been completed in step S332', the controller 130 executes steps S333 to S335, etc. in a similar manner that the controller 130 determines in step S332 that the recording of all the partial images-to-be-recorded has been ended.

The above-described processings are suitable in a case that the multi-functional peripheral 10 records a same image in a plurality pieces of the sheet 12, as in a so-called copy printing (printing of one certain image to a plurality of sheets). Note that it is not necessarily indispensable that the minimum margin value is stored in the EEPROM 134. For example, it is allowable that a necessity of detecting the actual both end positions or lack of the necessity is determined previously based on the comparison of the minimum margin value and the margin threshold value, and that information in which the first identification information and indication information indicating the necessity of detecting the actual both end positions or lack of the necessity are associated with each other is stored in the EEPROM 134. In this case, in a case that the controller 130 determines in step S34 that the first condition is satisfied, the controller 130 can determine the necessity of detecting the actual both end positions or lack of the necessity, without executing steps S35 and S36.

<Effects of Embodiment>

According to the above-described embodiment, in a case that an image-to-be-recorded which is same as the recorded image is to be recorded on the sheet 12, the minimum margin value stored in the minimum margin DB 400 of the RAM 133 can be substituted for the minimum value of the margin in the image-to-be-recorded, even in a case that the controller 130 does not receive all the partial margin information of the image-to-be-recorded. As a result, it is possible to further suppress such a situation that the image-to-be-recorded is recorded on the sheet 12 while being lopsided to or deviated to one side in the second orientation 9A, and this makes the ESAT to be faster.

<First Modification>

Figure 10:
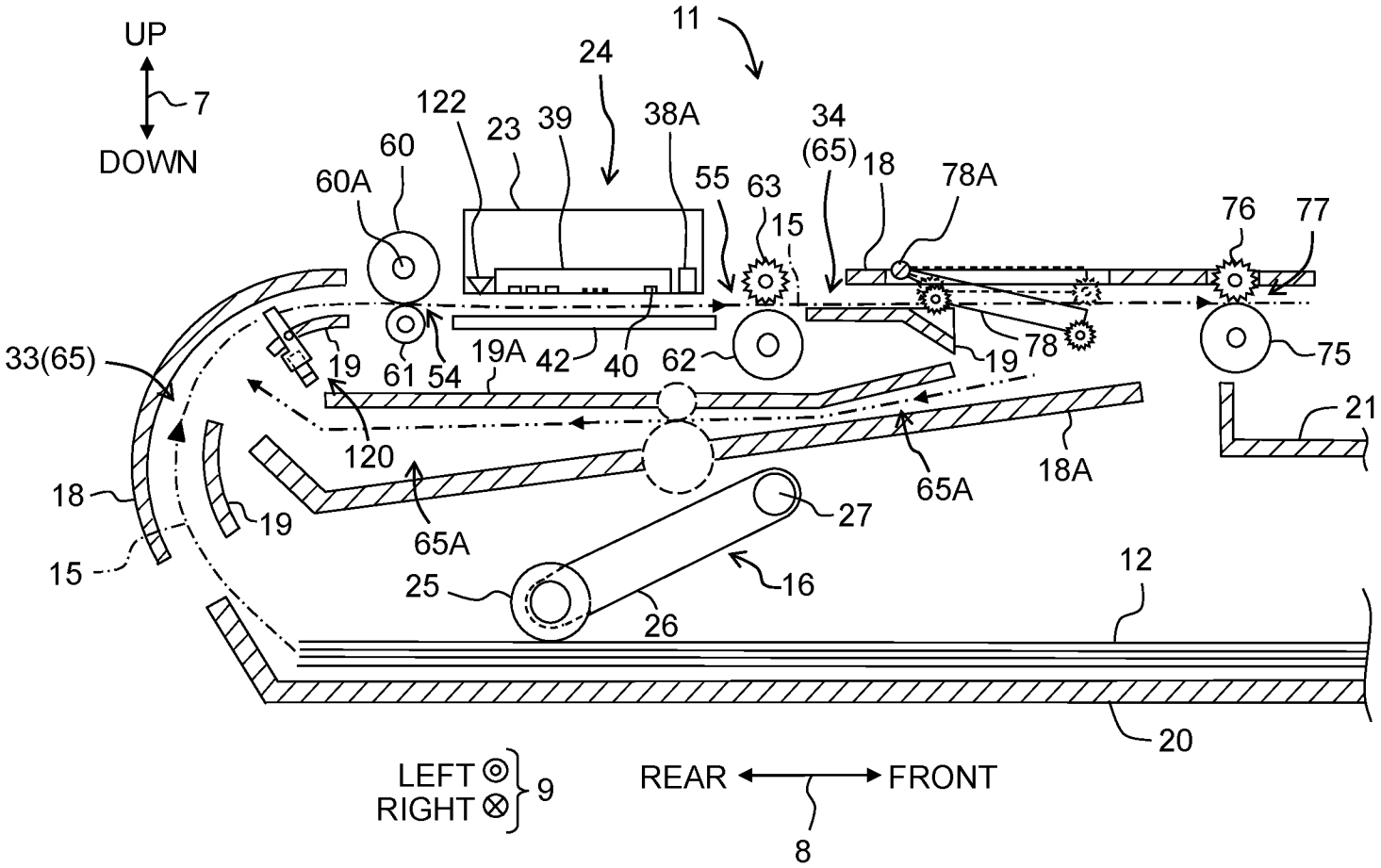
FIG. 10 is a schematic view depicting the configuration of a multi-functional peripheral 10 according to a first modification.

A multi-functional peripheral 10 according to a modification of the present disclosure and as depicted in FIG. 10 further includes: a reversal roller pair 77, a flap 78 and a reverse conveying route 65A, as compared to the multi-functional peripheral 10 depicted in FIG. 3.

<Reversal Roller Pair 77>

As depicted in FIG. 10, the reversal roller pair 77 is located, in the straight part 34 of the conveying route 65, at the downstream in the conveying orientation 15 of the discharging roller pair 55. The reversal roller pair 77 includes a reversal roller 75 and a spur 76. The reversal roller 75 extends in the left-right direction 9 along the straight part 34, at a location below the straight part 34. The reversal roller 75 rotates in the forward direction and in the backward direction due to the driving force generated in the conveying motor 102 (see FIG. 1). The spur 76 makes contact with the reversal roller 75 from the position above the reversal roller 75 and rotates following the rotation of the reversal roller 75. The sheet 12 is conveyed in the conveying orientation 15 by being nipped by the reversal roller 75 rotating in the forward direction and the spur 76 rotating following the rotation of the reversal roller 75, and is conveyed in a reverse orientation reverse to the conveying orientation 15 by being nipped by the reversal roller 75 rotating in the backward direction and the spur 76 rotating following the rotation of the reversal roller 75.

<Flap 78 and Reverse Conveying Route 65A>

As depicted in FIG. 10, the flap 78 is located, in the straight part 34, between the discharging roller pair 55 and the reversal roller pair 77. The flap 78 extends in the conveying orientation 15 from a shaft 78A located above the straight part 34 and is supported to be rotatable about the shaft 78A between a discharge position and a reversal position. The discharge position is a position at which the sheet 12 is allowed to be discharged to the discharge tray 21, and is a position generally along the upper side the straight part 34. The reversal position is a position at which an extended end part of the flap 78 is positioned lower than the position of the extended end part when the flap 78 is located at the discharge position. In FIG. 10, the flap 78 at the discharge position is indicated by a broken line, and the flap 78 at the reversal position is indicated by a solid line.

The flap 78 is located at the reversal position due to the self-weight in a state that any force which is different from the gravity is not applied to the flap 78. In contrast, while the flap 78 is making contact with the sheet 12 which is being conveyed in the straight part 34, the flap 78 is lifted from the reversal position to the discharge position by the sheet 12. Thus, in a case that the rear end of the sheet 12 reaches the extended end part of the flap 78, the flap 78 rotates from the discharge position to the reversal position due to the self-weight thereof. As a result, the rear end of the sheet 12 is directed to the reverse conveying route 65A (to be described later). In this state, in a case that the reversal roller pair 77 continues to rotate in the forward direction, the sheet 12 is conveyed in the conveying orientation 15 to be discharged to the discharge tray 21. On the other hand, in a case that the rotational direction of the reversal roller pair 77 is switched to the reverse orientation, the sheet 12 is conveyed in a reverse orientation reverse to the conveying orientation 15 and is conveyed to the curved part 33 via the reverse conveying route 65A.

The reverse conveying route 65A is a conveying route connecting a branching position, in the straight part 34, between the discharging roller pair 55 and the reversal roller pair 77, and a merging (joining) position on the upstream side of the conveying roller pair 54 in the curved part 33. Namely, the reverse conveying route 65A reverses the sheet 12 having the recorded image recorded on a front surface of the sheet 12 so that a rear surface (back surface) of the sheet faces 12 the plurality of ejection port 40 and guides the reversed sheet to the outer guide member 18 and the inner guide member 19. The reverse conveying route 65A is defined by guide members 18A and 19A. The guide members 18A and 19A are an example of a "second guide", and the reverse conveying route 65A is an example of a "second conveying route".

<Image Recording Processing by Multi-Functional Peripheral 10>

Next, a processing by the multi-functional peripheral 10 will be explained, with reference to FIG. 11.

Figure 11:
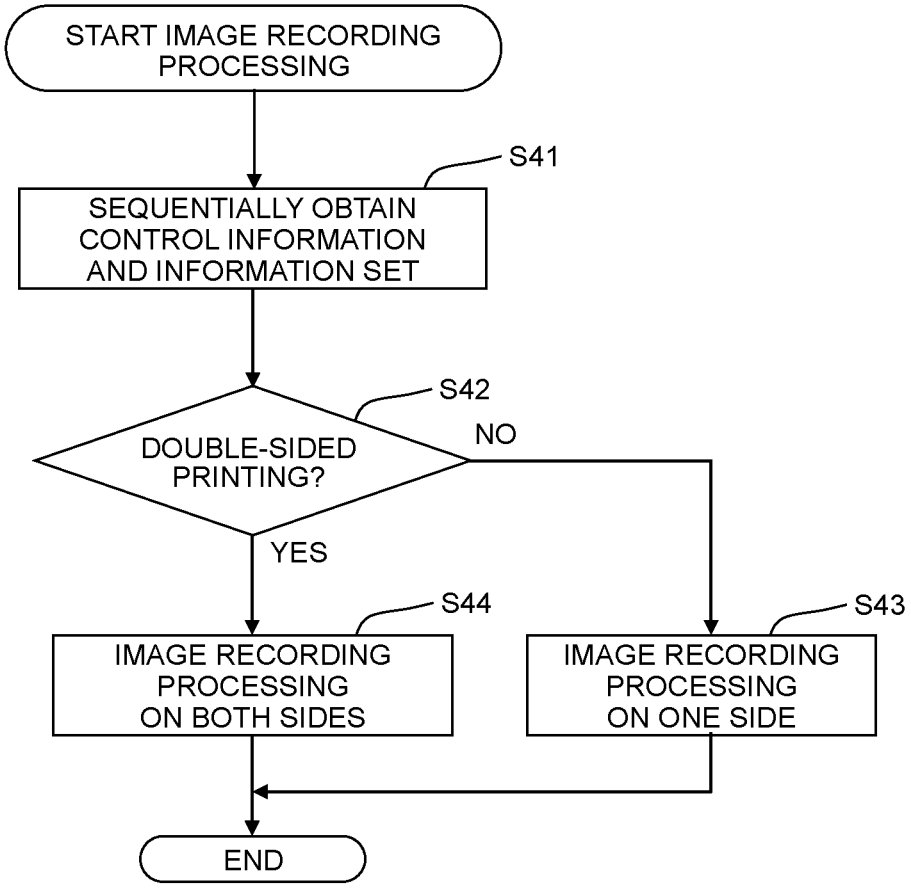
FIG. 11 is a flow chart indicating an image recording processing of the multi-functional peripheral 10 according to the first modification.

In step S41 of FIG. 11, the controller 130 sequentially obtains the control information and the information set, in a similar manner as that in step S31. Here, in the present modification, the control information includes condition information for designating a double-sided printing as a recording condition.

In step S42, the controller 130 determines whether or not the condition information included in the control information designates the double-sided printing. In a case that the double-sided printing is not designated in the condition information, the controller 130 executes the image recording processing onto one side of the sheet 12 (step S43). Since step S43 is similar to the processing depicted in FIGS. 7A, 7B, 7C, 8A and 8B, any explanation thereof will be omitted. On the other hand, in a case that the double-sided printing is designated, the controller 130 executes an image recording processing for double-sided printing (step S44).

The image recording processing for double-sided printing may be similar to that in FIGS. 7A, 7B, 7C, 8A and 8B, except for the following differences, and thus will not be described in detail.

The first difference relates to the cueing processing. The cueing processing in the present modification includes a first cueing processing and a second cueing processing. The first cueing processing is executed in a case that the image-to-be-recorded is to be recorded in a recording surface on a front side of the sheet 12 (hereinafter also referred to as a "first recording surface"). The first cueing processing is the processing as described in the above-described embodiment. On the other hand, the second cueing processing is executed in a case that the image-to-be-recorded is to be recorded on a recording surface on a back side of the sheet 12 (hereinafter also referred to as a "second recording surface"). The second cueing processing is a processing of conveying the sheet 12, which has been guided to the curved part 33 through the reverse conveying route 65A, to the recording start position.

The second difference relates to the margin threshold value. The margin threshold value includes a first margin threshold value and a second margin threshold value. The second margin threshold value is greater than the first margin threshold value. In a case that the partial images-to-be-recorded which construct the image-to-be-recorded are to be recorded on the first recording surface, the controller 36 uses the first margin threshold value as the margin threshold value in steps S36 and S324. On the other hand, in a case that the image-to-be-recorded is to be recorded on the second recording surface, the controller 36 uses the second margin threshold value as the margin threshold value in steps S36 and S324.

The position of the sheet 12 conveyed in the reverse conveying route 65A is easily deviated on the platen 42. Therefore, by using the second margin threshold value in step S36, there is a higher possibility that the second condition is determined to be satisfied in step S36 at the time of recording on the second recording surface. In other words, there is an increased possibility that steps S37 to S314 might be executed. Similarly, by using the second margin threshold value in step S324, there is an increased possibility that steps S325 to S332 might be executed. As a result, it is possible to suppress such a situation that the image-to-be-recorded is recorded on the sheet 12 while being lopsided or deviated in the second orientation 9A. According to the above-described processing, in a case that the image-to-be-recorded is to be recorded on the second recording surface (the recording surface on the back side) of the sheet 12, it is possible to increase the possibility that both end positions of the sheet 12 might be derived, thereby suppressing the occurrence of any positional deviation of the image-to-be-recorded recorded on the back surface of the sheet 12.

Note that in such a case that the second margin threshold value is made to be not less than a size in the width direction of the sheet 12, the second condition and the third condition are always determined to be satisfied, at the time of executing the recording on the second recording surface. According to the above-described processing, in a case that the image-to-be-recorded is recorded on the second recording surface (the recording surface on the back side) of the sheet 12, the both end positions of the sheet 12 are always derived, thereby making it possible to suppress the occurrence of any positional deviation of the image-to-be-recorded recorded on the back surface of the sheet 12.

<Other Modifications>

In the above-described embodiment and the first modification, the controller 130 derives the actual both end positions based on the electric signals ES3 and ES4 (step S37). However, the present disclosure is not limited to this, and one of the media sensor 122 and the encoder sensor 38A may derive the actual both end positions based on the electric signal ES3 or ES4, and may output the actual both end positions to the controller 130.

In the above-described embodiment, the minimum margin value is stored in the minimum margin DB 400. However, the present disclosure is not limited to this; all the partial margin information included in the information set of the designated recording order may be stored in the minimum margin DB 400. As a result, it is possible to cope with such a situation that a write error, etc., occurs while storing (writing) the minimum margin value on (to) the minimum margin DB 400.

In the above-described embodiment, although the multi-functional peripheral 10 is of a so-called serial system, the multi-functional peripheral 10 may be of a so-called the line system. In a case of the line system, the recording head 24 is spanned or straddles over both ends in the left-right direction 9 of the platen 42 and ejects or discharges the ink to the sheet 12 without moving on the platen 42. Specifically, the recording head 24 includes a plurality of ejecting modules 39 and the plurality of the ejecting modules 39 are arranged in a staggered arrangement (i.e. some nozzles of ejecting modules are overlapped in the rear-front direction 8 so that one ejecting module and another ejecting module can eject the same area of the sheet 12) in the left-right direction 9 of the platen 42. Further, in a case of the line system, the media sensor 122 is a line sensor that is long in the left-right direction 9 and is arranged along the recording head 24. Furthermore, in the case of the line system, the encoder sensor 38A and the encoder strip 38B are not required.

In the above-described embodiment, in step S34, it is determined whether or not the first identification information and the second identification information match (coincide) with each other. However, the present disclosure is not limited to this; it is allowable that the controller 130 stores, in the minimum margin DB 400, additional information (an example of "first additional information") such as an update date of the electronic file and/or a file size of the electronic file, etc., while further associating the additional information with the first identification information and the minimum margin value which are associated with each other. In such a case, the information processing apparatus 150 transmits, together with the second identification information, additional information (an example of "second additional information") such as an update date of the electronic file and/or a file size of the electronic file, to the multi-functional peripheral 10. Namely, the controller 130 further obtains the second additional information of the image-to-be-recorded. The controller 130 may determine, in step S34, whether or not these pieces of the additional information match with each other, in addition to whether or not the first identification information and the second identification information match with each other. Specifically, in a case that the first identification information and the second identification information match with each other (are same as each other) and that the first additional information and the second additional information match with each other (are same as each other), the controller 130 determines whether or not the minimum margin information obtained in step S35 indicates the value smaller than the margin threshold value. In a case that the minimum margin value indicates the value smaller than the margin threshold value, the controller 130 derives, by using the media sensor 122, the position of the sheet 12 which is (being) conveyed by the conveying roller pair 54, and then executes the ejection of the ink from the plurality of ejection ports 40 based on the detected position of the sheet 12 and the image-to-be-recorded. With this, the precision of the determination of whether or not the minimum value, which is the minimum margin value stored in the minimum margin DB 400, is the same as the minimum value of the margin in the image-to-be-recorded, becomes to be high. Note that in a case that the minimum margin value does not indicate the value smaller than the margin threshold value, the controller 130 executes the ejection of the ink from the plurality of ejection ports 40 based on the image-to-be-recorded, without deriving the position of the sheet 12 which is (being) conveyed by the conveying roller pair 54.

According to the embodiment and modifications as described above, it is possible to further suppress the occurrence of such a situation that the image is recorded on the sheet while being lopsided to or deviated closer to one side in the main scanning direction.

What is claimed is:

1. An image recording apparatus comprising:

a conveyer configured to convey a sheet in a first orientation;

a platen configured to support the sheet being conveyed by the conveyer;

a sensor configured to output a signal corresponding to presence or absence of the sheet supported by the platen;

a recording head having a plurality of ejection ports and configured to record an image on the sheet supported by the platen;

a memory; and a controller, wherein:

the controller is configured to store, in the memory, first identification information and a minimum margin value in a state that the first identification information and the minimum margin value are associated with each other, the first identification information being information for identifying a recorded image having been recorded on a recording surface of the sheet, the minimum margin value being a minimum value of partial image margins, along a second orientation intersecting the first direction, of a plurality of recorded partial images obtained by dividing the recorded image in the first orientation;

the controller is configured to obtain second identification information for identifying an image-to-be-recorded being an image planned to be recorded on the recording surface, and a plurality of partial images-to-be-recorded obtained by dividing the image-to-be-recorded in a first orientation; and in a case that the obtained second identification information is same as the first identification information stored in the memory, the controller is configured to determine whether the minimum margin value stored in the memory is smaller than a threshold value or not, and then:

in a case that the minimum margin value is smaller than the threshold value, the controller is configured to derive, by the sensor, an edge position in the second orientation of the sheet being conveyed by the conveyer, and then execute ejection of ink from the plurality of ejection ports based on the derived edge position in the second orientation of the sheet and the image-to-be-recorded; and in a case that the minimum margin value is not smaller than the threshold value, the controller is configured to execute the ejection of the ink from the plurality of ejection ports based on the image-to-be-recorded without deriving the edge position in the second orientation of the sheet being conveyed by the conveyer.

2. The image recording apparatus according to claim 1, wherein:

the controller is configured to execute a preparing processing for preparation of recording of the image-to-be-recorded; and in a case that the first identification information same as the obtained second identification is not stored in the memory, the controller is configured to determine, in response to completion of the preparing processing, whether or not partial image margins along the second orientation of all of the plurality of partial images-to-be-recorded obtained by dividing the image-to-be-recorded in the first orientation have been obtained, and then:

in a case that the partial image margins of all of the plurality of partial images-to-be-recorded have been obtained, and each of the partial image margins of all of the plurality of partial images-to-be-recorded is not smaller than the threshold value, the controller is configured to execute the ejection of the ink from the plurality of ejection ports based on a predetermined reference position; and in a case that the partial image margins of all of the plurality of partial images-to-be-recorded have not been obtained, or in a case that the partial image margins of all of the plurality of partial images-to-be-recorded have been obtained and at least one of the partial image margins of all of the plurality of partial images-to-be-recorded is smaller than the threshold value, the controller is configured to derive, by the sensor, the edge position in the second orientation of the sheet being conveyed by the conveyer, and then execute the ejection of the ink from the plurality of ejection ports based on the derived edge position in the second orientation of the sheet and the image-to-be-recorded.

3. The image recording apparatus according to claim 2, wherein:

the controller is configured to store, in the memory, first additional information being additional information of the recorded image in a state that the first additional information is associated with the first identification information and the minimum margin value;

the controller is further configured to obtain second additional information of the image-to-be-recorded; and in a case that the first identification information same as the obtained second identification information is stored in the memory, and that the first additional information same as the obtained second additional information is stored in the memory, the controller is configured to determine whether the minimum margin value stored in the memory is smaller than the threshold value or not, and then:

in a case that the minimum margin value is smaller than the threshold value, the controller is configured to derive, by the sensor, the edge position in the second orientation of the sheet being conveyed by the conveyer, and then execute the ejection of the ink from the plurality of ejection ports based on the derived edge position in the second orientation of the sheet and the image-to-be-recorded; and in a case that the minimum margin value is not smaller than the threshold value, the controller is configured to execute the ejection of the ink from the plurality of ejection ports based on the image-to-be-recorded without deriving the edge position in the second orientation of the sheet being conveyed by the conveyer.

4. The image recording apparatus according to claim 3, wherein:

in a case that the first identification information same as the obtained second identification information is not stored in the memory, the controller is configured to store, in the memory, information for identifying the image-to-be-recorded planned to be recorded on the recording surface of the sheet, as the first identification information;

the controller is configured to obtain partial image margins along the second orientation of a plurality of partial images-to-be-recorded obtained by dividing the image-to-be-recorded in the first orientation; and the controller is configured to store, in the memory, a minimum value of the obtained partial image margins as the minimum margin value, in a state that the minimum margin value is associated with the first identification information.

5. The image recording apparatus according to claim 2, comprising a carriage movable in the second orientation, wherein the controller is configured to move, prior to derive a position of the sheet, the carriage in the second orientation along the platen supporting the sheet, and to derive the edge position in the second orientation of the sheet based on a signal from the sensor outputted as the carriage is being moved.

6. The image recording apparatus according to claim 2, comprising:

a supply tray configured to support the sheet;

a first guide configured to guide the sheet fed from the supply tray to the platen; and a second guide configured to reverse the sheet having an image recorded on a front surface of the sheet so that a back surface of the sheet faces the plurality of ejection ports and to guide the sheet to the first guide member;

wherein in a case that the first identification information same as the obtained second identification information is not stored in the memory, and that the image-to-be-recorded is to be recorded on the back surface, the controller is configured to derive the edge position in the second orientation of the sheet, without determining whether or not all the partial margin images have been obtained.

7. The image recording apparatus according to claim 1, comprising:

a supply tray configured to support the sheet;

a first guide configured to guide the sheet fed from the supply tray to the platen; and a second guide configured to reverse the sheet having the recorded image recorded on a front surface of the sheet so that a back surface of the sheet faces the plurality of ejection ports and to guide the sheet to the first guide member;

wherein the threshold value includes a first threshold value used in a case that the image-to-be-recorded is recorded on the front surface and a second threshold value used in a case that the image-to-be-recorded is recorded on the back surface, the second threshold value being greater than the first threshold value.

8. An image recording apparatus comprising:

a first conveyer configured to convey a sheet in a first orientation;

a sensor configured to detect an edge position of the sheet;

an ejector configured to eject an ink onto the sheet;

a carriage supporting the ejector, configured to move in a second orientation crossing the first orientation;

a memory; and a controller, wherein:

the controller is configured to execute a first determining processing of determining whether or not specifying information is stored in the memory;

in a case that the specifying information is not stored in the memory, the controller is configured to execute a detecting processing of detecting the edge position of the sheet by the sensor; and the specifying information is information based on first identification information and a minimum margin value, the first identification information being information for identifying a recorded image having been recorded on a recording surface of the sheet, the minimum margin value being a minimum value of image margins, along the second orientation, of a plurality of partial images obtained by dividing the recorded image in the first orientation.

9. The image recording apparatus according to claim 8, wherein:

the specifying information includes information indicating whether executing of the detecting processing is necessary or not obtained based on the minimum margin value, and in a case that the specifying information is stored in the memory, the controller is configured to execute or not to execute the detecting processing according to the information indicating whether executing of the detecting processing is necessary or not included in the specifying information.

10. The image recording apparatus according to claim 8, wherein:

in a case that the information based on the first identification information and the minimum margin value is stored in the memory, the controller is configured to execute a second determining processing of determining whether the minimum margin value is smaller than a margin threshold value; and in a case that the minimum margin value is smaller than the margin threshold value, the controller is configured to execute the detecting processing.

11. The image recording apparatus according to claim 10, wherein, in a case that the minimum margin value is not smaller than the margin threshold value, the controller is configured not to execute the detecting processing.

12. The image recording apparatus according to claim 10, comprising a second conveyer configured to reverse the sheet so that a back surface of the sheet faces the ejector and to convey the sheet;

the margin threshold value includes a first margin threshold value and a second margin threshold value greater than the first margin threshold value; and the controller is configured to use the first margin threshold value in the second determining processing before the sheet is conveyed by the second conveyer, and to use the second margin threshold value in the second determining processing after the sheet has been conveyed by the second conveyer.

13. The image recording apparatus according to claim 8, wherein:

the controller is configured to execute a third determining processing of determining whether or not all of a plurality of partial images-to-be-recorded obtained by dividing an image-to-be-recorded in the first orientation are stored in the memory; and in a case that the controller determines that all of the plurality of partial images-to-be-recorded are not stored in the memory, the controller is configured to execute the detecting processing.

14. The image recording apparatus according to claim 13, wherein:

in a case that the controller determines that all of the plurality of partial images-to-be-recorded are stored in the memory, the controller is configured to execute:

a first obtaining processing of obtaining image margins along the second orientation of the plurality of partial images-to-be-recorded, a second obtaining processing of obtaining a minimum margin value, of the image-to-be-recorded, being a minimum value of the image margins of the plurality of partial images-to-be-recorded, and a fourth determining processing of determining whether or not the minimum margin value of the image-to-be-recorded is smaller than a margin threshold value; and in a case that the minimum margin value of the image-to-be-recorded is smaller than the margin threshold value, the controller is configured to execute the detecting processing.

15. The image recording apparatus according to claim 14, wherein in a case that the minimum margin value of the image-to-be-recorded is not smaller than the margin threshold, the controller is configured not to execute the detecting processing.

16. The image recording apparatus according to claim 8, wherein:

in a case that the information based on the first identification information and the minimum margin value is stored in the memory, the controller is configured to execute:

a second determining processing of determining whether the minimum margin value is smaller than a margin threshold value; and a fifth determining processing of determining whether or not first additional information being additional information of the recorded image and second additional information being additional information of an image-to-be-recorded match with each other; and in a case that the first additional information and the second additional information match with each other, and the minimum margin value is smaller than the margin threshold value, the controller is configured to execute the detecting processing.

17. An image recording apparatus comprising:

a first conveyer configured to convey a sheet in a first orientation;

a line sensor configured to detect an edge position of the sheet;

a line head having a plurality of ejectors each configured to eject an ink onto the sheet;

a memory; and a controller, wherein the controller is configured to execute a first determining processing of determining whether or not information based on first identification information and a minimum margin value is stored in the memory, the first identification information being information for identifying a recorded image having been recorded on a recording surface of the sheet, the minimum margin value being a minimum value of image margins, along a second orientation intersecting the first orientation, of a plurality of partial images obtained by dividing the recorded image in the first orientation, and in a case that the information based on the first identification information and the minimum margin value is not stored in the memory, the controller is configured to execute a detecting processing of detecting the edge position of the sheet by the line sensor.

18. The image recording apparatus according to claim 17, wherein:

in a case that the information based on the first identification information and the minimum margin value is stored in the memory, the controller is configured to execute a second determining processing of determining whether the minimum margin value is smaller than a margin threshold value; and in a case that the minimum margin value is smaller than the margin threshold value, the controller is configured to execute the detecting processing.

19. The image recording apparatus according to claim 17, wherein:

the controller is configured to execute a third determining processing of determining whether or not all of a plurality of partial images-to-be-recorded obtained by dividing an image-to-be-recorded in the first orientation are stored in the memory; and in a case that the controller determines that all of the plurality of partial images-to-be-recorded are not stored in the memory, the controller is configured to execute the detecting processing.

* * * * *